US010320114B2

(12) United States Patent
Suzuki et al.

(10) Patent No.: US 10,320,114 B2
(45) Date of Patent: Jun. 11, 2019

(54) WATERPROOF CONNECTOR

(71) Applicant: Sumitomo Wiring Systems, Ltd., Yokkaichi, Mie (JP)

(72) Inventors: Masakazu Suzuki, Mie (JP); Kazuo Nakai, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/894,010

(22) Filed: Feb. 12, 2018

(65) Prior Publication Data

US 2018/0248304 A1 Aug. 30, 2018

(30) Foreign Application Priority Data

Feb. 24, 2017 (JP) ..... 2017-033250

(51) Int. Cl.

*H01R 13/52* (2006.01)
*H01R 13/502* (2006.01)
*H01R 13/58* (2006.01)
*H01R 13/629* (2006.01)

(52) U.S. Cl.

CPC ..... *H01R 13/5227* (2013.01); *H01R 13/502* (2013.01); *H01R 13/5205* (2013.01); *H01R 13/582* (2013.01); *H01R 13/62977* (2013.01)

(58) Field of Classification Search

CPC ..... H01R 13/5227
USPC ..... 439/902, 206, 205
See application file for complete search history.

(56) References Cited

U.S. PATENT DOCUMENTS 5,672,078 A * 9/1997 Fukamachi ..... H01R 13/518 439/701
5,688,144 A * 11/1997 Kosuge ..... H01R 13/516 439/466
5,947,762 A * 9/1999 Katsuma ..... H01R 13/5202 439/157
6,203,362 B1 * 3/2001 Tsuji ..... H01R 13/506 439/470
6,354,852 B2 * 3/2002 Noro ..... H01R 13/62938 439/157
6,817,888 B2 * 11/2004 Kozono ..... H01R 13/62933 439/468

(Continued)

FOREIGN PATENT DOCUMENTS

JP 2013-131484 7/2013

*Primary Examiner* — Tulsidas C Patel
*Assistant Examiner* — Peter G Leigh
(74) *Attorney, Agent, or Firm* — Gerald E. Hespos; Michael J. Porco; Matthew T. Hespos

(57) ABSTRACT

A waterproof connector (1) includes an accommodation recess (31) formed in a wire draw-out surface (26) of a housing (10) and configured to accommodate a ventilation film (63). A wire cover (50) is mounted on the housing (10) to cover the wire draw-out surface (26) and the accommodation recess (31). A wire bending space (54) inside the wire cover (50) is configured to bend wires (15) drawn out from the wire draw-out surface (26). A partition (56) is formed in the wire cover (50) and partitions between the accommodation recess (31) and the wire bending space (54) by contacting the wire draw-out surface (26) to cover an opening of the accommodation recess (31). Drainage portions (37, 38, 39, 40) are formed in a contact area between the wire draw-out surface (26) and the partition (56) and has a convexo-concave or stepped cross-sectional shape.

5 Claims, 27 Drawing Sheets

(56) References Cited

U.S. PATENT DOCUMENTS

| | | | | |
|---|---|---|---|---|
| 7,922,503 | B1 * | 4/2011 | Kobayashi | H01R 13/6295 439/157 |
| 8,257,101 | B2 * | 9/2012 | Ichio | H01R 13/4367 439/206 |
| 8,568,159 | B2 * | 10/2013 | Noda | H01R 13/5812 439/470 |
| 8,662,910 | B2 * | 3/2014 | Ichio | H01R 13/5208 439/206 |
| 9,287,652 | B2 * | 3/2016 | Torii | H01R 13/506 |
| 2007/0087599 | A1 * | 4/2007 | Sasaki | H01R 13/6295 439/157 |
| 2016/0013580 | A1 * | 1/2016 | Matsuda | H01R 13/5202 439/190 |
| 2016/0013587 | A1 * | 1/2016 | Shimizu | H01R 13/5227 439/153 |
| 2016/0352039 | A1 * | 12/2016 | Yamaki | H01R 13/506 |

* cited by examiner

WATERPROOF CONNECTOR

BACKGROUND

Field of the Invention

The invention relates to a waterproof connector.

Description of the Related Art

Japanese Unexamined Patent Publication No. 2013-131484 discloses a connector in which a waterproof plug having a ventilation film is inserted into a cavity of a housing in an airtight manner. This connector can alleviate a pressure difference by causing air to flow through the ventilation film while keeping the inside of the housing airtight when the pressure difference is generated between the inside and outside of the housing.

The cavity accommodating the ventilation film originally is a space into which a terminal fitting is inserted. Thus, the number of poles is sacrificed by providing the ventilation film in the connector. Thought has been given to a structure for mounting a ventilation film in an accommodation recess formed in a wire draw-out surface of a housing that is covered by a wire cover. However, the wire cover has wire pull-out openings to accommodate wires drawn out from the wire draw-out surface to the outside of the wire cover. Thus, water penetrating through the wire pull-out openings may be pooled in the accommodation recess, and a ventilation function of the ventilation film may be lost.

The invention was completed based on the above situation and arranges a ventilation film on a wire draw-out surface without impairing a ventilation function of the ventilation film.

SUMMARY

The invention is directed to a waterproof connector with a housing formed with a terminal accommodation chamber inside. The housing has an outer surface that includes a wire draw-out surface. A terminal fitting is connected to an end part of a wire and is inserted into the terminal accommodation chamber with the wire drawn to outside of the housing from the wire draw-out surface. An accommodation recess is formed in the wire draw-out surface and is configured to accommodate a ventilation film. A wire cover configured to cover the wire draw-out surface and the accommodation recess. A wire bending space is formed inside the wire cover and is configured to bend the wire drawn out from the wire draw-out surface. A partitioning portion formed in the wire cover and is configured to partition between the accommodation recess and the wire bending space by being brought into contact with the wire draw-out surface to cover an opening of the accommodation recess. A drainage portion is formed in a contact area between the wire draw-out surface and the partitioning portion and has a convexo-concave or stepped cross-sectional shape.

Water may penetrate into the wire bending space from outside the wire cover and may adhere to the outer surface of the accommodation recess or the partitioning portion. That water may penetrate into the accommodation recess. However, the drainage portion is formed in the contact area between the wire draw-out surface and the partitioning portion and has a convexo-concave or stepped cross-sectional shape. Thus, the water in the wire bending space cannot penetrate into the accommodation recess, and the ventilation film can be arranged on the wire draw-out surface without impairing a ventilation function of the ventilation film.

The opening of the accommodation recess may face up, and a drainage path may be formed in the housing to open in a lower surface of the accommodation recess. According to this configuration, any water that penetrates into the accommodation recess is discharged to the outside of the housing through the drainage path. Thus, there is no possibility that water is pooled in the accommodation recess.

A blocking portion may be formed at an intermediate position of a drainage route in the drainage path and may form the drainage path into a bent route. According to this configuration, the bent part blocks any water that penetrates into the drainage path from a downstream end of the drainage path and moves toward the accommodation recess. Thus, there is no possibility that the water reaches the accommodation recess.

A one-piece rubber plug may be mounted in the housing with the wire passed therethrough in an airtight manner. A peripheral wall may be formed in the housing and may be configured to surround the one-piece rubber plug in an airtight manner. A tubular ventilation portion may penetrate through the one-piece rubber plug and may be configured to accommodate the ventilation film. The accommodation recess may be formed from an inner side to an outer side of the peripheral wall, and an upstream end of the drainage path may be open in an area of the accommodation recess outside the peripheral wall. According to this configuration, the shape of the tubular ventilation portion and that of the drainage path can be simplified.

A restricting portion may be formed in the wire cover and may be configured to restrict a displacement of the ventilation film in a direction separating from the accommodation recess. According to this configuration, the separation of the ventilation film from the accommodation recess can be prevented even if the accommodation recess is not formed with a resiliently deformable locking means. Thus, the shape of the accommodation recess can be simplified.

DETAILED DESCRIPTION

Figure 8:
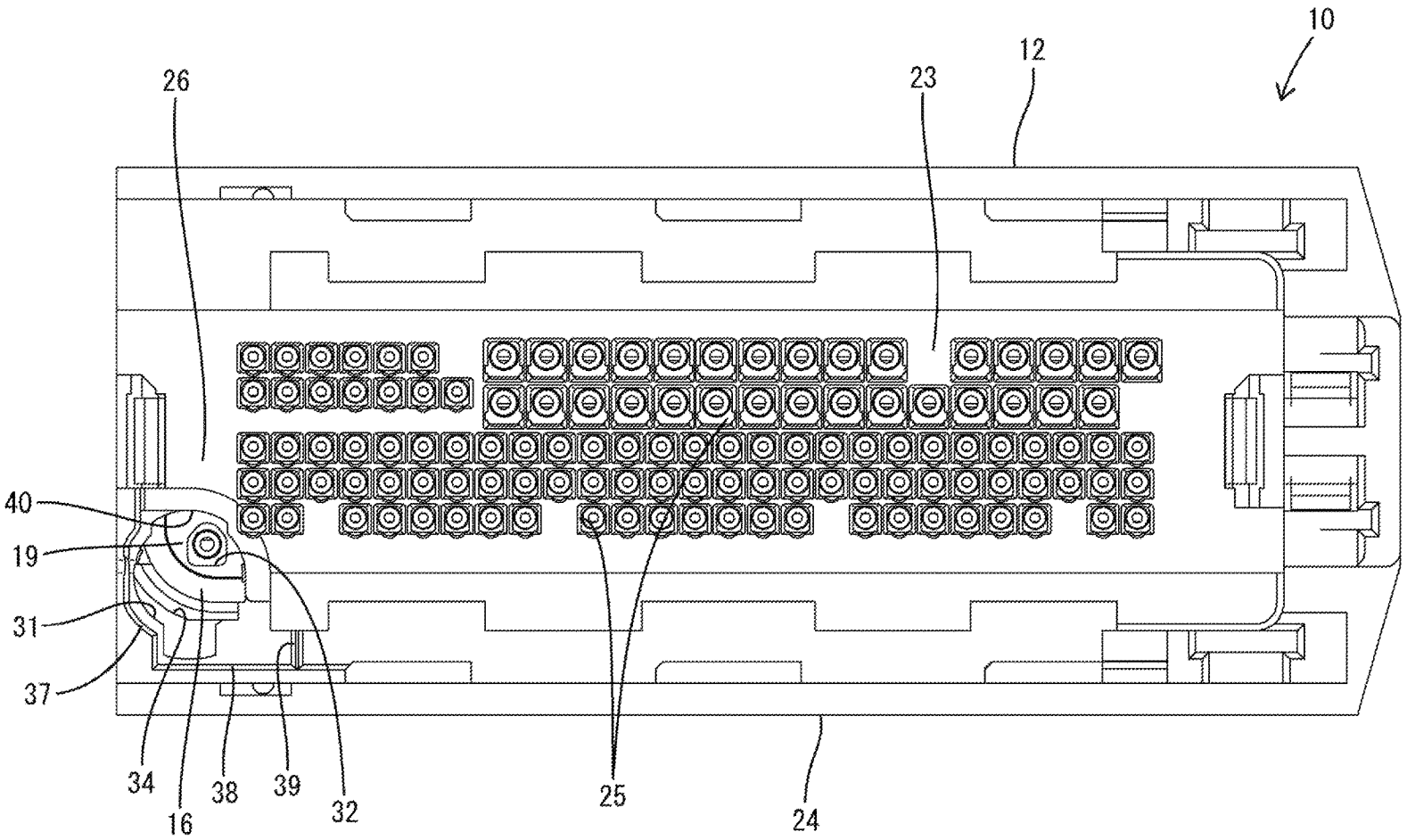
FIG. 8 is a plan view showing the ventilation member removed from FIG. 5.
Figure 9:
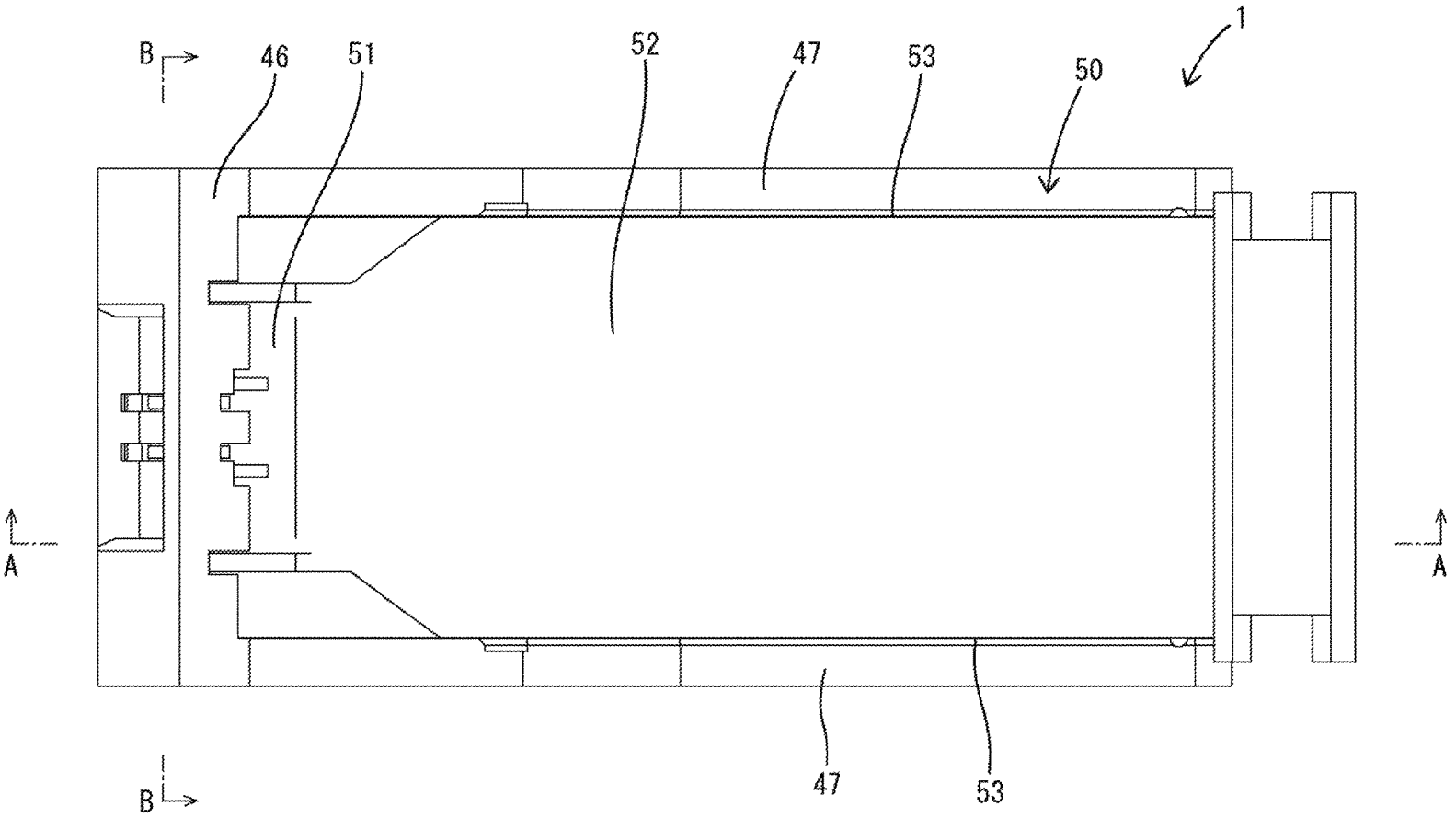
FIG. 9 is a plan view of the connector.
Figure 12:
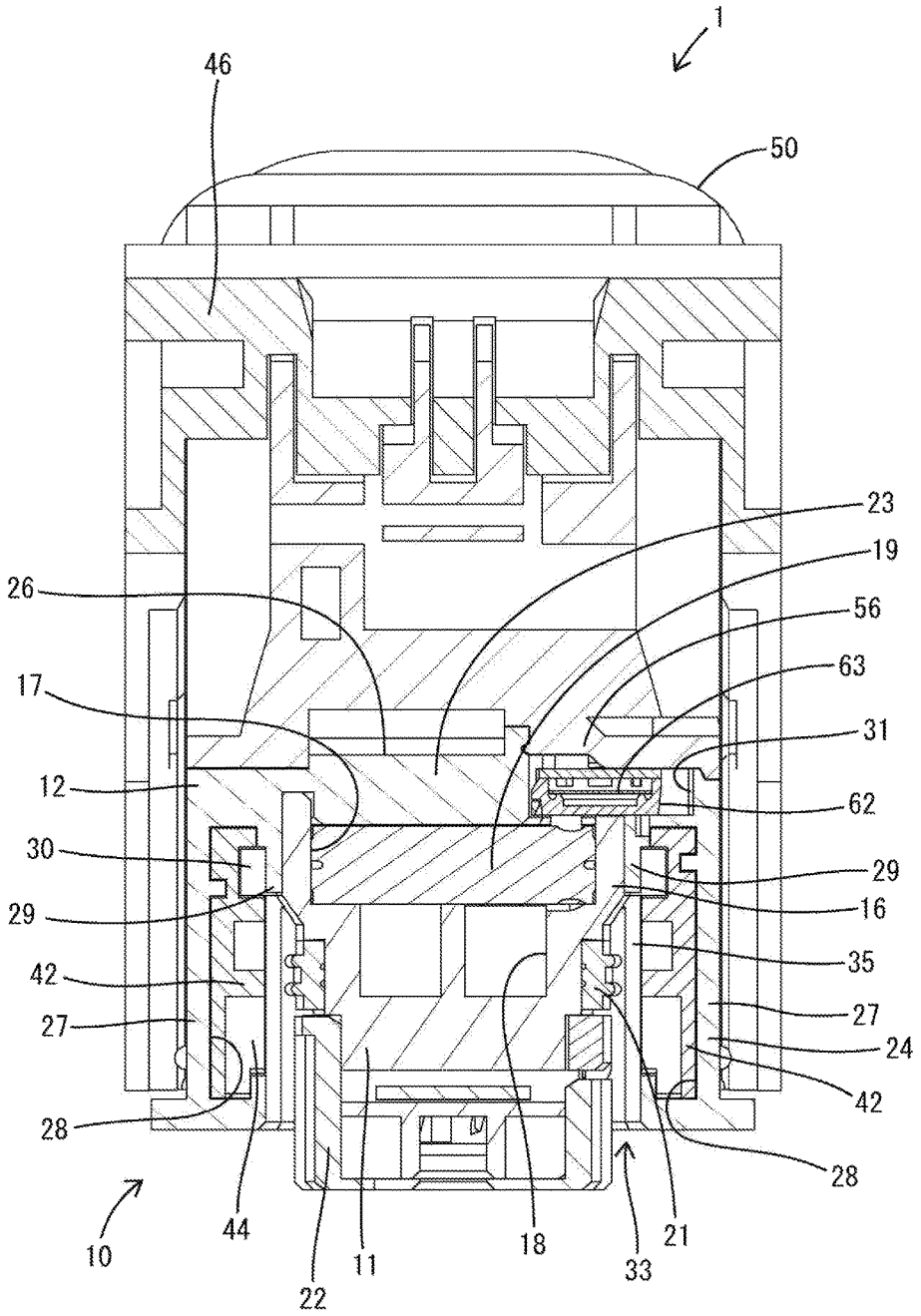
FIG. 12 is a section along B-B of FIG. 9.
Figure 13:
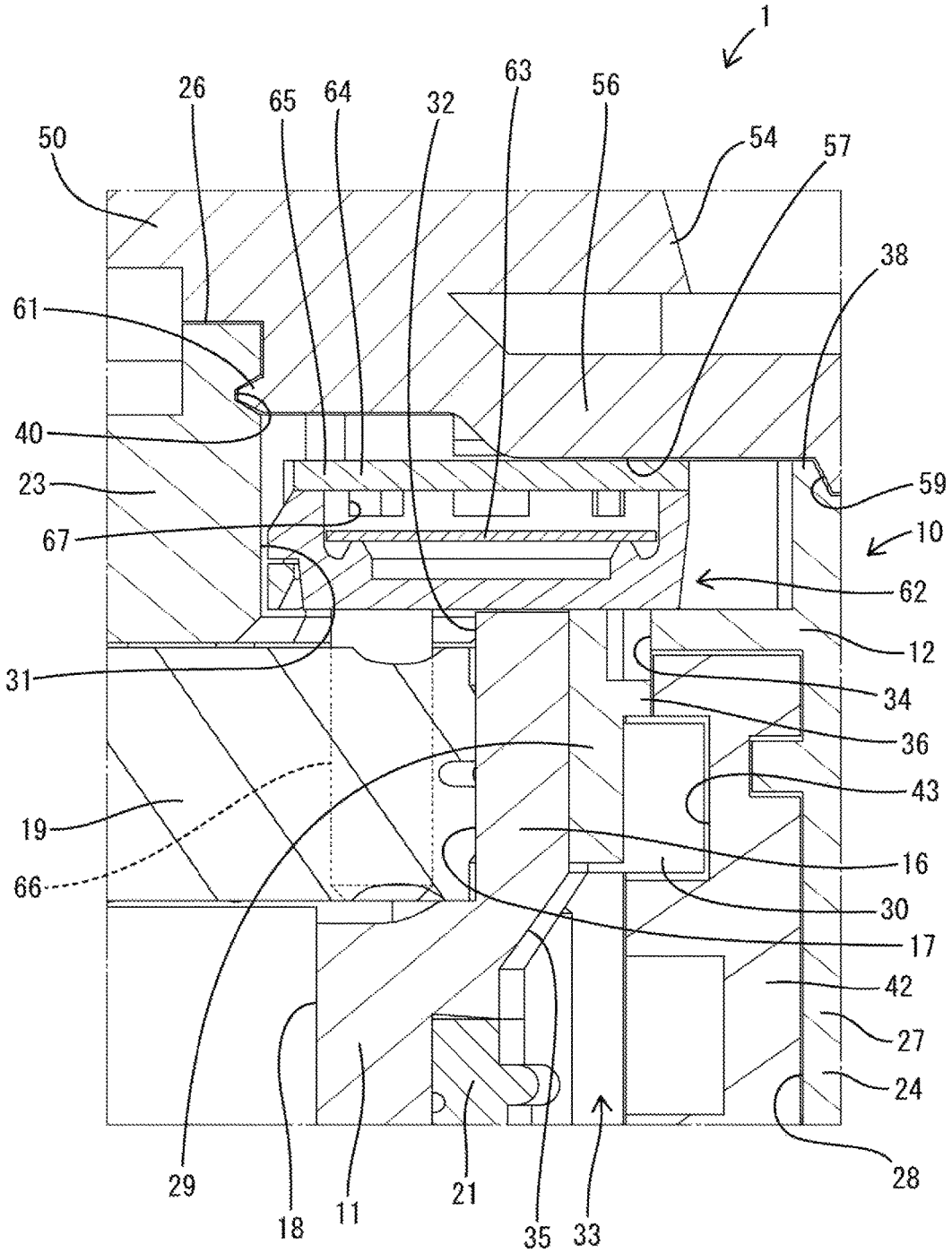
FIG. 13 is a partial enlarged view of FIG. 12.

A first embodiment of the invention is described with reference to FIGS. 1 to 16. Note that, in the following description, a right side in FIGS. 1 to 4 and a left side in FIGS. 5, 6, 8 to 11, 14 and 15 are defined as a front concerning a front-rear direction. Upper and lower sides shown in FIGS. 1 to 4, 6, 7, 10 to 13, 15 and 16 are directly defined as upper and lower sides concerning a vertical direction. A lower side in FIGS. 5 and 8 is defined as a left side and left and right sides shown in FIGS. 12 and 13 are directly defined as left and right sides concerning a lateral direction.

A waterproof connector 1 of the first embodiment includes a housing 10, female terminal fittings 14, a one-piece rubber plug 19, a seal ring 21, two sliders 42, a lever 46, a wire cover 50 and a ventilation member 62. With the housing 10 connected to a mating housing, a sealing space (not shown) isolated from the outside of the waterproof connector 1 in an airtight manner is configured in a clearance between the housing 10 and the mating housing (not shown) and is disposed inside the housing 10 by the seal ring 21 and the one-piece rubber plug 19.

<Housing 10>

The housing 10 includes an inner housing 11 made of synthetic resin and an outer housing 12 made of synthetic resin and assembled with the inner housing 11 from above. Terminal accommodation chambers 13 (see FIG. 10) are formed inside the inner housing 11, and a terminal fitting 14 connected to a wire 15 is inserted into each terminal accommodation chamber 13 from above (from a back surface side of the housing 10).

A peripheral wall 16 in the form of a rectangular tube extends up along the outer peripheral edge of the upper surface of an upper end part of the inner housing 11. A space enclosed by the peripheral wall 16 serves as a rubber plug accommodation space 17 open to the upper ends of all the terminal accommodation chambers 13. The inner housing 11 is formed with a ventilation space 18 (see FIG. 12) allowing the rubber plug accommodation space 17 to communicate with the sealing space in the inner housing 11.

<One-Piece Rubber Plug 19>

The one-piece rubber plug 19 is fit in the rubber plug accommodation space 17. The outer periphery of the one-piece rubber plug 19 is held in close contact with the inner periphery of the rubber plug accommodation space 17 in an airtight manner. The one-piece rubber plug 19 is formed with vertically penetrating sealing holes 20 (see FIG. 10) individually corresponding to the respective terminal accommodation chambers 13. Each sealing hole 20 defines a passage route when the terminal fitting 14 is inserted into the terminal accommodation chamber 13. The wire 15 is passed through each sealing hole 20 in an airtight manner.

<Seal Ring 21>

The seal ring 21 for sealing a clearance between the outer periphery of the inner housing 11 and the inner periphery of a receptacle (not shown) of the mating housing in an airtight manner is mounted on the outer periphery of the inner housing 11. The seal ring 21 is mounted from below the inner housing 11 (a front surface side of the housing 10) and held mounted by a front member (see FIG. 12) attached to a lower end part of the inner housing 11.

<Outer Housing 12>

Figure 1:
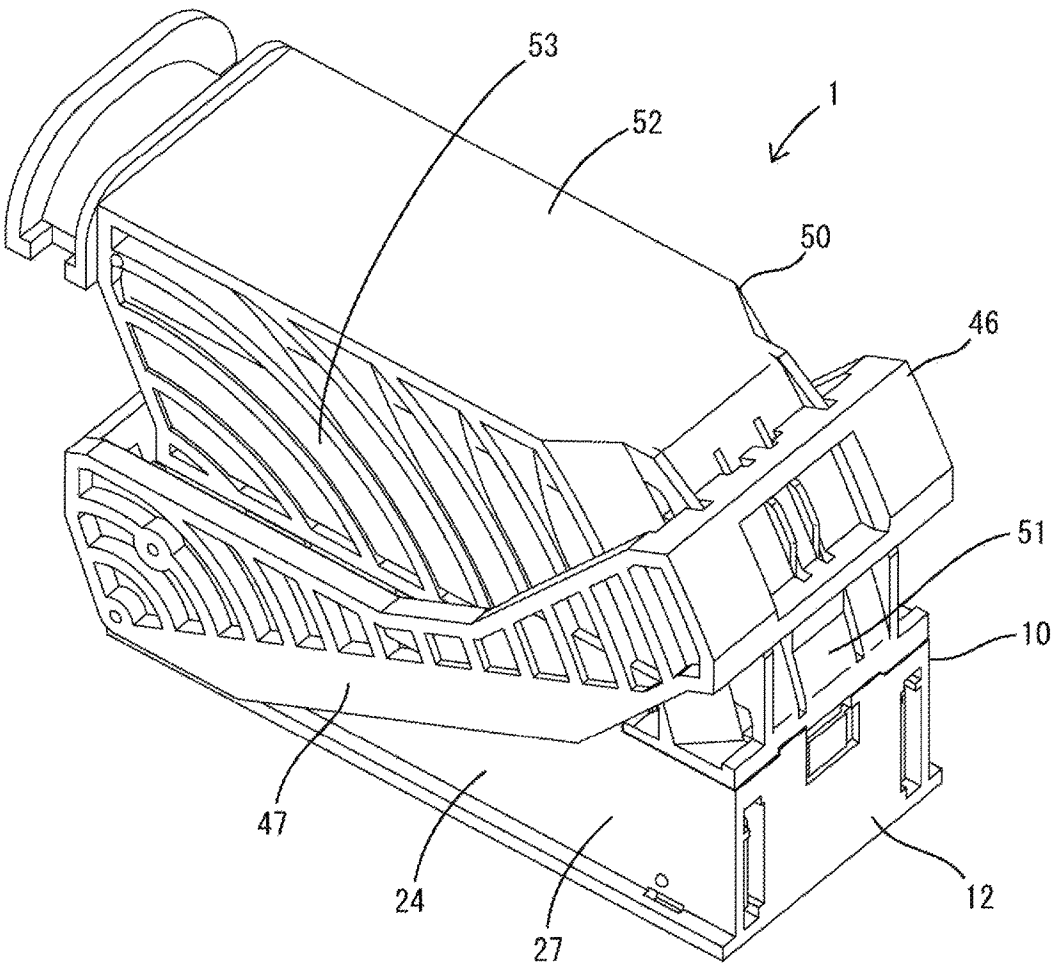
FIG. 1 is a perspective view of a connector of a first embodiment.
Figure 2:
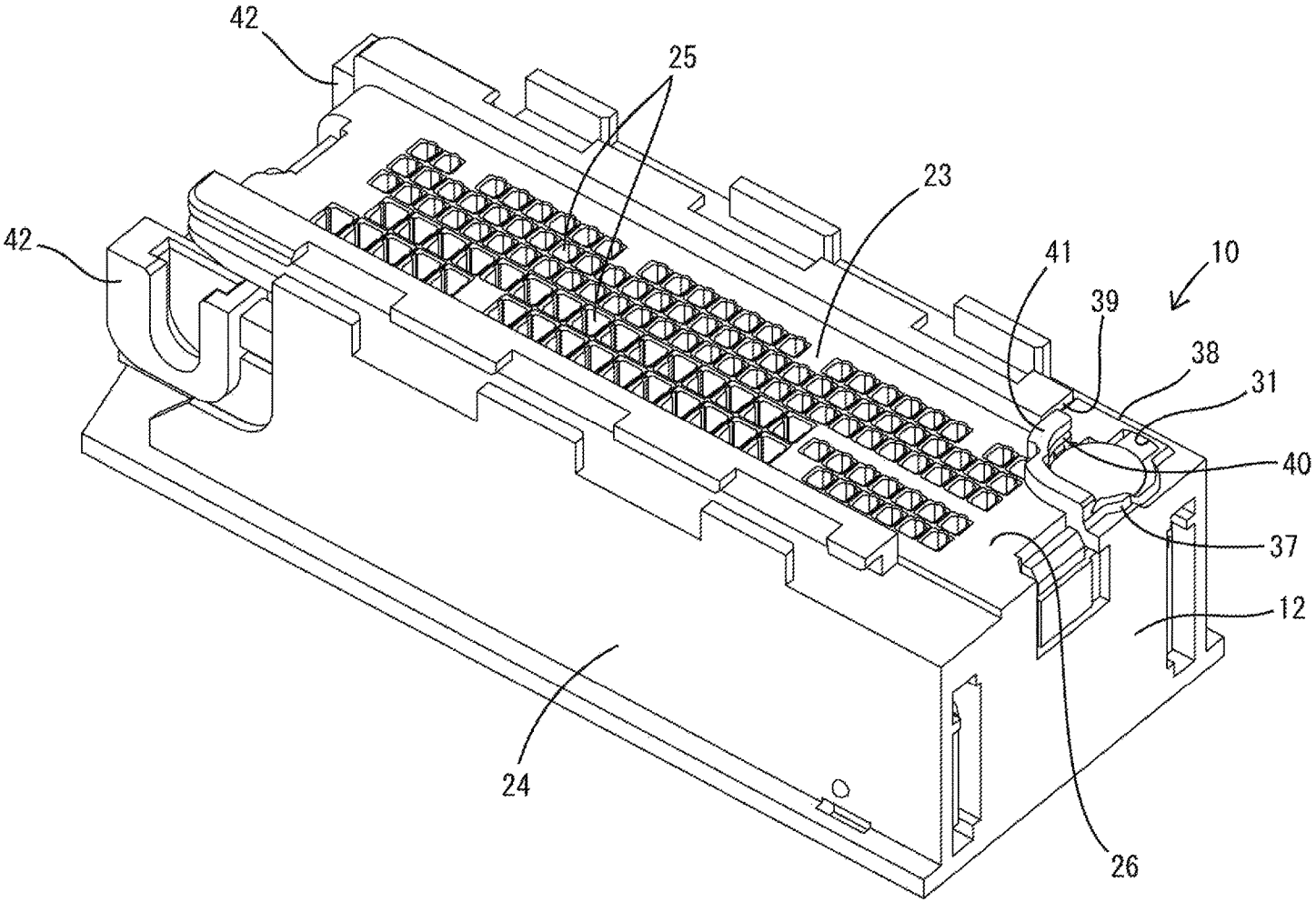
FIG. 2 is a perspective view showing a wire cover and wires removed from FIG. 1.
Figure 3:
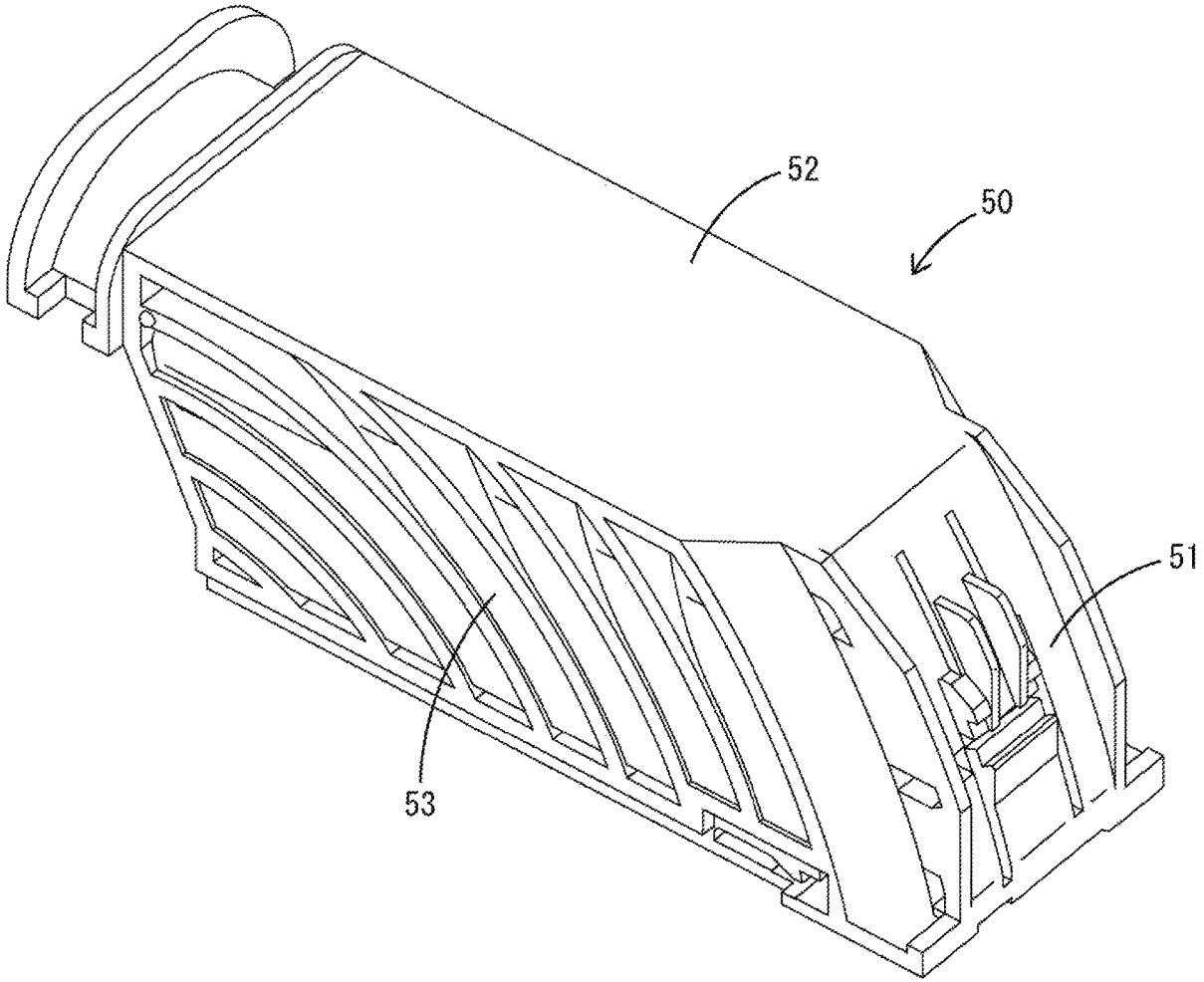
FIG. 3 is a perspective view of the wire cover.
Figure 10:
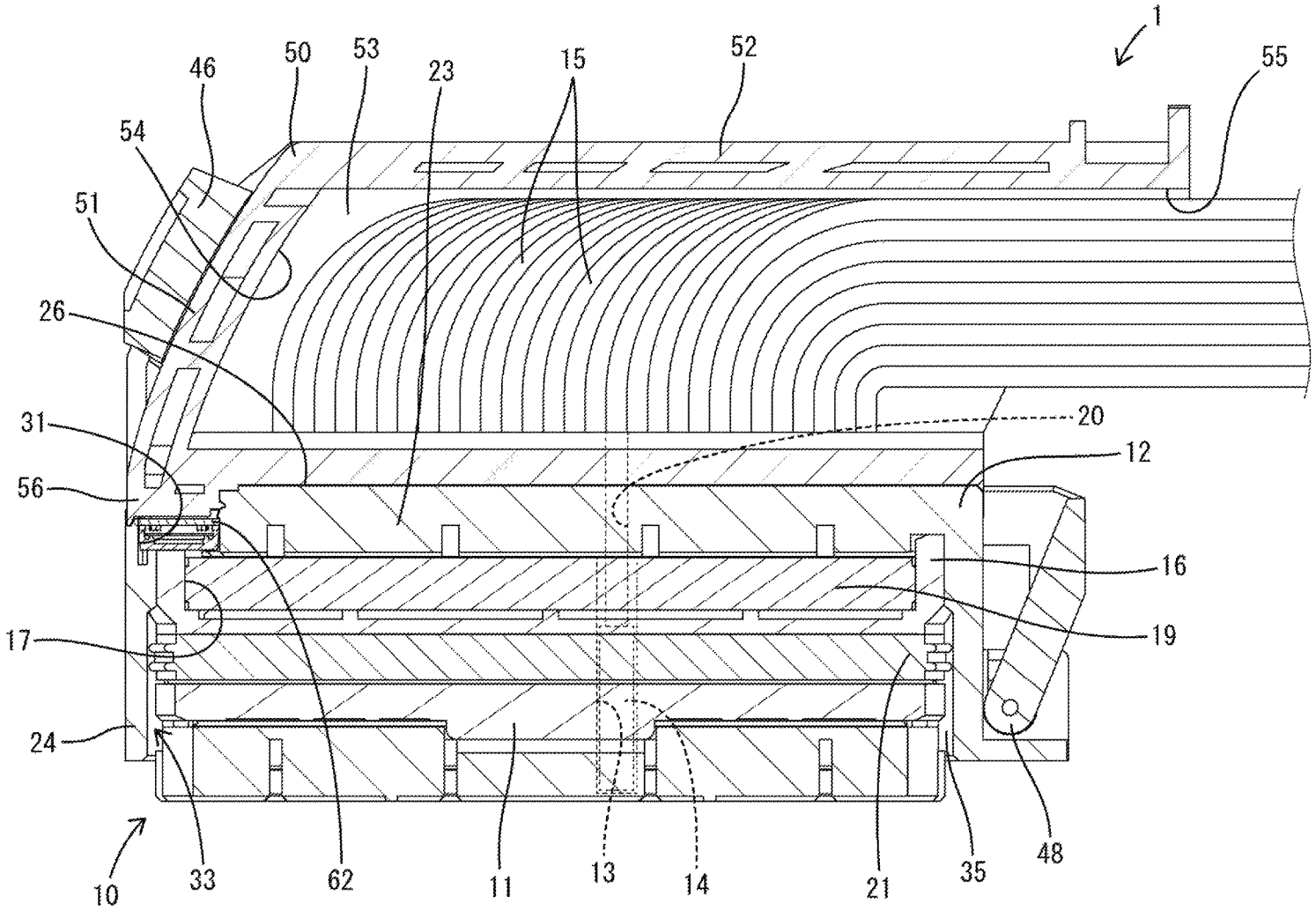
FIG. 10 is a section along A-A of FIG. 9.
Figure 11:
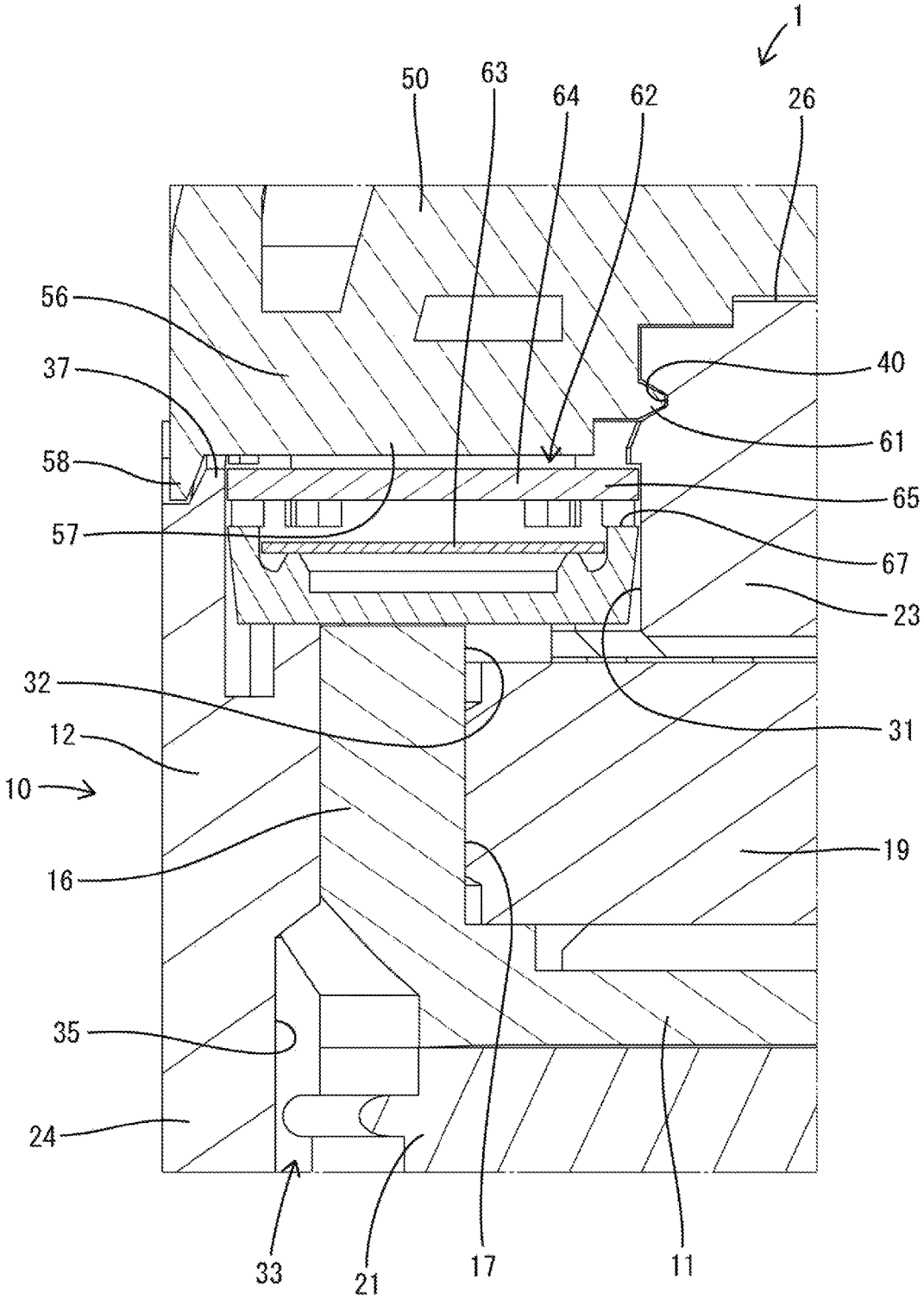
FIG. 11 is a partial enlarged view of FIG. 10.

The outer housing 12 is assembled with the inner housing 11 from above (back side). As shown in FIGS. 10 and 12, the outer housing 12 includes a back wall 23 and a tubular fitting 24. The back wall 23 covers an opening in the upper surface of the rubber plug accommodation space 17 and is held in contact with the upper surface (back surface) of the one-piece rubber plug 19. As shown in FIGS. 2, 5 and 8, the back wall 23 is formed with vertical penetrating insertion holes 25 individually corresponding to the terminal accommodation chambers 13 and the sealing holes 20. Each insertion hole 25 serves as the passage route when the terminal fitting 14 is inserted into the terminal accommodation chamber 13. The wire 15 fixed to the terminal fitting 14 is inserted into each insertion hole 25. The upper surface of the back wall 23 (housing 10) serves as a wire draw-out surface 26 from which wires 15 are drawn out upward.

The tubular fitting 24 extends down from the outer peripheral edge of the back wall 23 and surrounds the outer periphery of the inner housing 11 (peripheral wall 16) over the entire periphery. A space between the outer periphery of the inner housing 11 and the inner periphery of the tubular fitting 24 serves as a connection space 35 for accommodating the receptacle. With the mating housing and the housing 10 connected, the receptacle surrounds the inner housing 11 and the tubular fitting 24 surrounds the receptacle.

As shown in FIGS. 12 and 13, left and right side walls 27 constituting the tubular fitting 24 are formed with left and right guide recesses 28 open in the inner surfaces of the side walls 27 and extending in the front-rear direction. Supporting plates 29 project down from the back wall 23 and long in the front-rear direction are formed on upper ends of both left and right guide recesses 28. Sliding pins 30 project toward the guide recesses 28 from the left and right supporting plates 29 while being spaced in the front-rear direction.

<Accommodation Recess 31>

The outer housing 12 is formed with an accommodation recess 31 for accommodating the ventilation member 62 to be described later. The accommodation recess 31 is formed by recessing a right-front end part of the upper surface (outer surface) of the back wall 23. In a plan view, the accommodation recess 31 is formed from the inside (rubber plug accommodation space 17) to the outside of the peripheral wall 16. Specifically, a front end part of the accommodation recess 31 is disposed outside the rubber plug accommodation space 17 (before the front end of the peripheral wall 16) and a rear end part of the accommodation recess 31 is disposed inside the rubber plug accommodation space 17.

Further, a right end part of the accommodation recess 31 is disposed outside the rubber plug accommodation space 17 (to the right of the right end of the peripheral wall 16) and a left end part of the accommodation recess 31 is disposed inside the rubber plug accommodation space 17. The upper surface of the accommodation recess 31 is entirely open in the wire draw-out surface 26. A communication hole 32 is formed in the lower surface of the accommodation recess 31 and communicates with the rubber plug accommodation space 17.

<Drainage Passages 33>

Drainage holes 34 (see FIGS. 8 and 13) are formed in the lower surface of the accommodation recess 31 and communicate with the upper ends of the guide recesses 28. The drainage holes 34 are disposed at positions near the supporting plates 29 in the lateral direction. The drainage holes 34, clearances between the inner surfaces of the guide recesses 28 and the sliders 42 and the connection space 35 between the tubular fitting 24 and the outer periphery of the inner housing 11 constitute drainage paths 33. The drainage paths 33 function as drainage routes for discharging water or liquid to the outside of the housing 10 when the water or liquid penetrates into the accommodation recesses 31.

A blocking portion 36 (see FIG. 13) is formed at an intermediate position of the drainage path 33. The blocking portion 36 laterally projects from a surface of the supporting plate 29 facing the rubber plug accommodation space 17. The upper surface of the blocking portion 36 is facing an opening in the lower end of the drainage hole 34 while being spaced therefrom. The projecting end surface of the blocking portion 36 slides in contact with the inner surface of the slider 42 or faces the inner surface of the slider 42 with a tiny clearance defined therebetween. An area of the drainage path 33 where the blocking portion 36 is formed serves as a route bent along both upper and lower surfaces and the projecting end surface of the blocking portion 36.

<Drainage Means of Wire Draw-Out Surface 26>

The wire draw-out surface 26 is formed with a drainage means surrounding the accommodation recess 31 substantially over the entire periphery in a plan view. As shown in FIGS. 5 and 8, the drainage means is composed of a front edge drainage portion 37 (drainage portion as claimed), a right edge drainage portion 38 (drainage portion as claimed), a rear edge drainage portion 39 (drainage portion as claimed) and an arcuate edge drainage portion 40 (drainage portion as claimed).

The front edge drainage portion 37 projects in a stepped manner from the wire draw-out surface 26 along the front edge of the accommodation recess 31. A planar shape of the front edge drainage portion 37 has a bent part and extends in the lateral direction as a whole. The front surface (outer surface) of the front edge drainage portion 37 obliquely stands up in a stepped manner from the wire draw-out surface 26. The right edge drainage portion 38 projects in a stepped manner from the wire draw-out surface 26 along the right edge of the accommodation recess 31. The right surface (outer surface) of the right edge drainage portion 38 extends straight rearward from the right end of the front surface of the front edge drainage portion 37 and obliquely stands up in a stepped manner from the wire draw-out surface 26.

The rear edge drainage portion 39 projects in a stepped manner from the wire draw-out surface 26 from the rear end of the upper surface of the right edge drainage portion 38. The front surface of the rear edge drainage portion 39 extends leftward a short distance from the rear end of the right edge drainage portion 38 in a plan view and obliquely stands up in a stepped manner from the upper surface of the right edge drainage portion 38. The arcuate drainage portion 40 is formed on the inner peripheral surface of a substantially quarter-circular rib 41 extending from a position near the left end of the rear edge drainage portion 39 to the left end of the front edge drainage portion 37 in a plan view. The arcuate drainage portion 40 is formed by recessing the inner peripheral surface of the substantially quarter-circular rib into a groove.

<Sliders 42>

Figure 4:
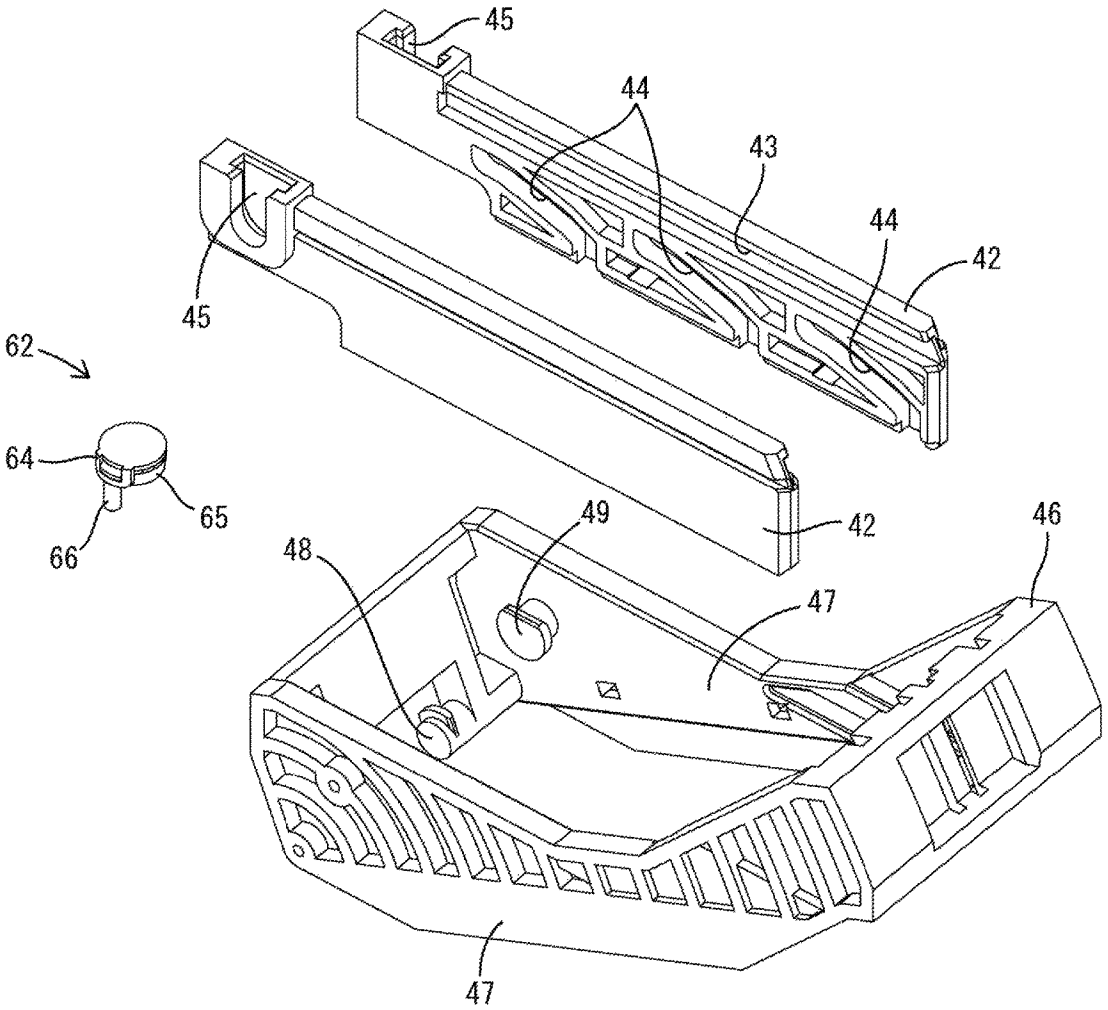
FIG. 4 is a perspective view of a lever, sliders and a ventilation member.
Figure 5:
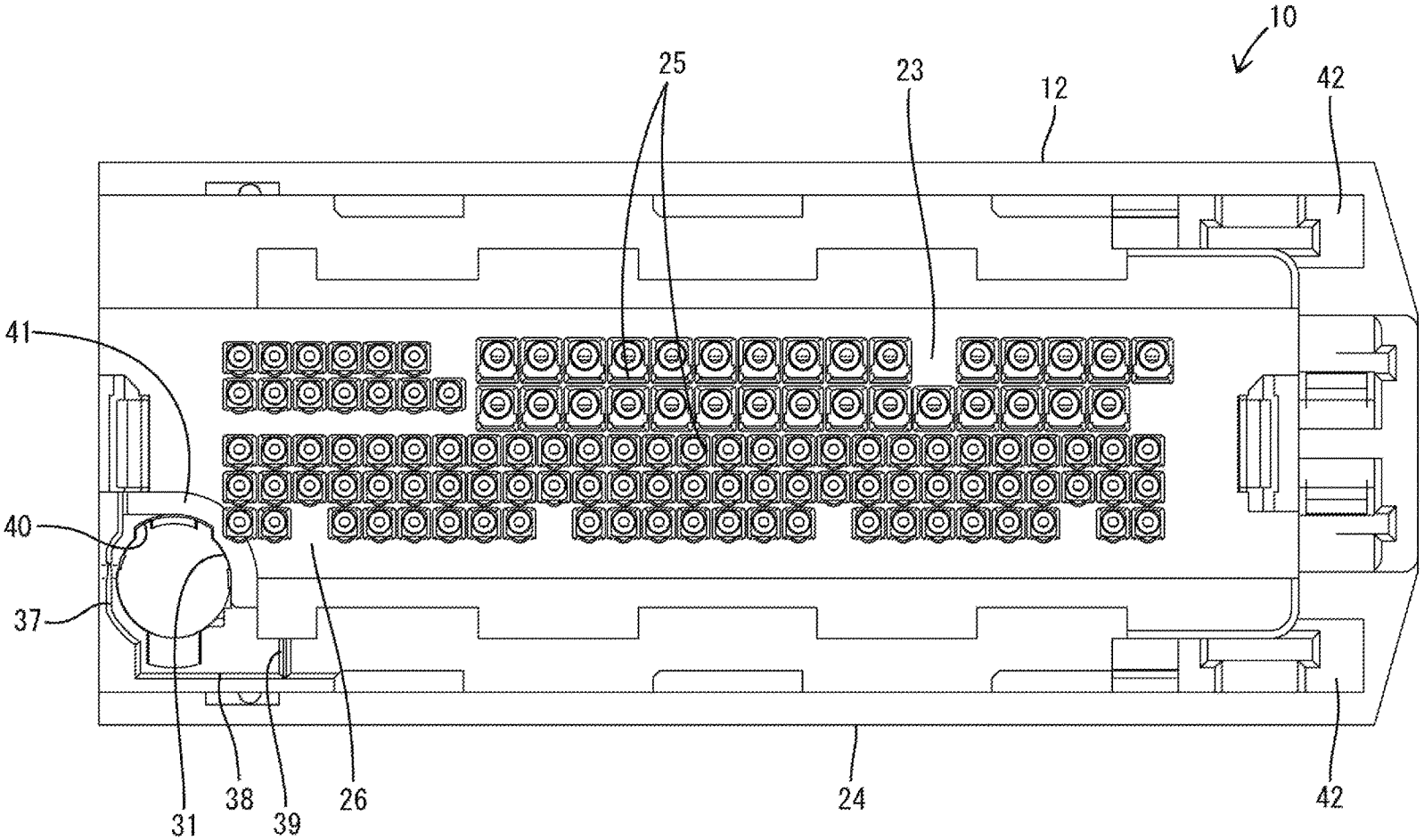
FIG. 5 is a plan view showing the ventilation member mounted in a housing.
Figure 6:
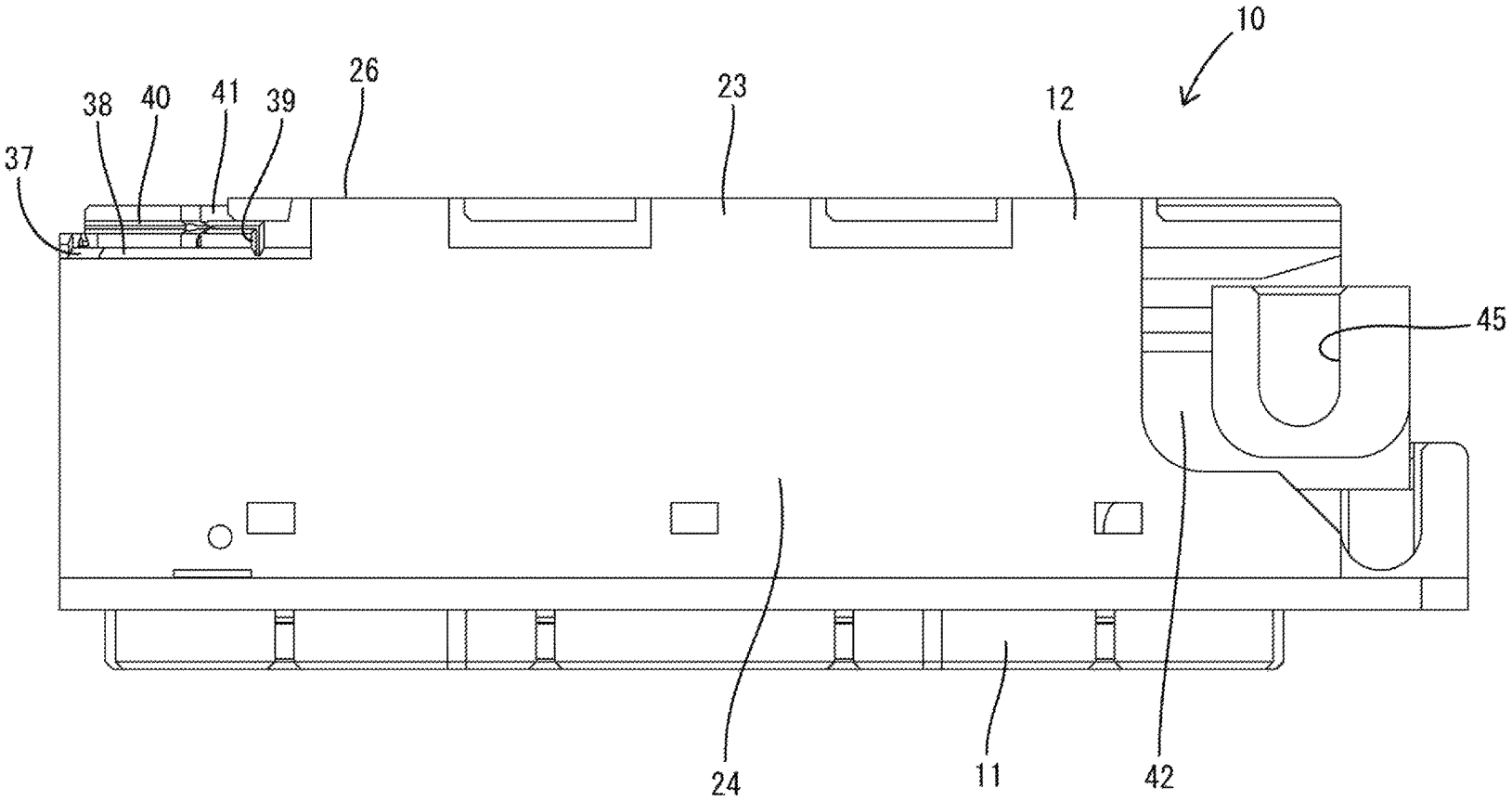
FIG. 6 is a right side view showing the ventilation member mounted in the housing.
Figure 7:
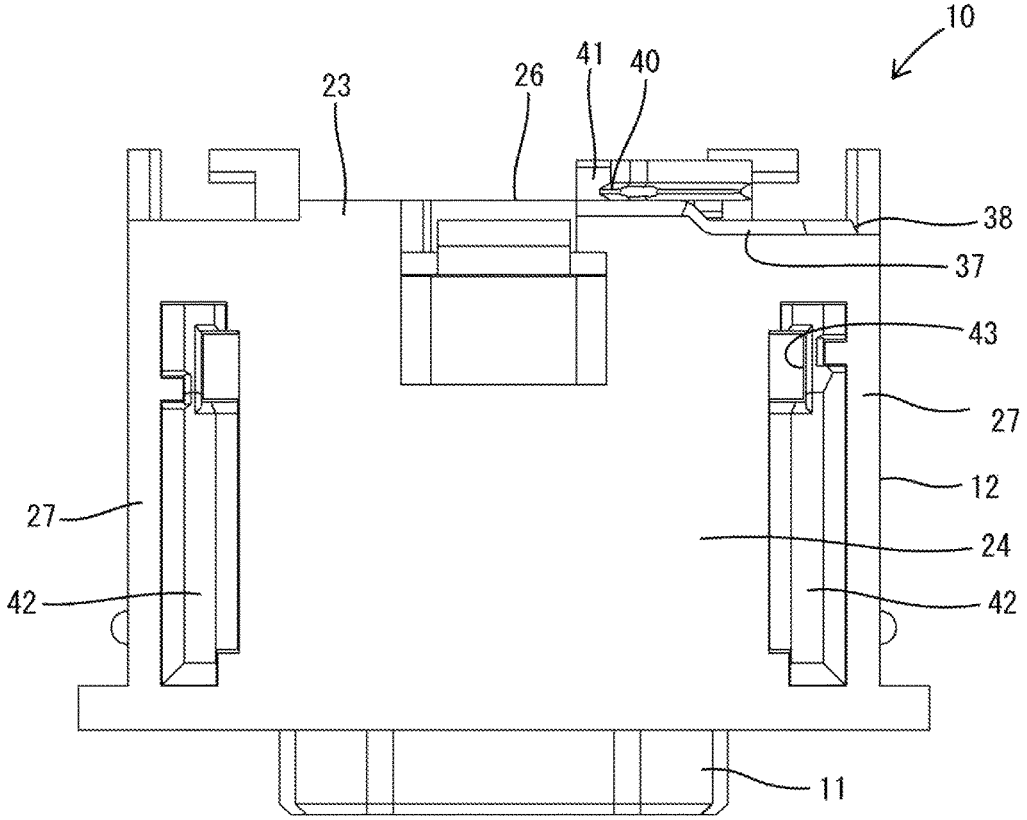
FIG. 7 is a front view showing the ventilation member mounted in the housing.

The pair of left and right sliders 42 are in the form of plates which are long and narrow in the front-rear direction and whose plate thickness directions are oriented in the lateral direction as shown in FIG. 4. The slider 42 is fit into the guide recess 28 with a sliding groove 43 formed in the inner surface of the slider 42 and extending in the front-rear direction fit to the sliding pins 30 of the inner housing 11, and slidable in the front-rear direction. Three cam grooves 44 arranged side by side in the front-rear direction are formed in the inner surface of the slider 42, and a driven hole 45 is formed in a rear end part of the outer side surface of the slider 42.

<Lever 46>

As shown in FIG. 4, the lever 46 is in the form of a substantially rectangular frame as a whole. A pair of left and right plate-like arm portions 47 constituting the lever 46 are formed with a pair of rotary shafts 48 and a pair of drive pins 49 projecting from rear end parts of the inner surfaces of the arm portions 47. The lever 46 is so mounted on the outer housing 12 as to be rotatable between an initial position and a connection position by locking the rotary shafts 48 to bearing portions (not shown) of the outer housing 12.

The drive pins 49 of the lever 46 are fit into the driven holes 45 of the sliders 42. When the lever 46 is rotated from the initial position to the connection position, the sliders 42 slide from an initial position to a connection position by a boosting action due to the principle of leverage. When the sliders 42 slide from the initial position to the connection position with cam followers (not shown) of the mating housing fit in the cam grooves 44, the housing 10 and the mating housing are connected by a boosting action by the cam grooves 44 and the cam followers.

<Wire Cover 50>

As shown in FIG. 10, the wire cover 50 is for turning the plurality of wires 15 drawn out upward from the wire drawn-out surface 26 of the housing 10 (outer housing 12) rearwardly. The wire cover 50 is mounted by being slid from front with respect to the outer housing 12 and covers the entire area of the wire drawn-out surface 26.

The wire cover 50 includes a front plate portion 51, an upper plate portion 52 extending rearward from the upper end edge of the front plate portion 51 and a pair of left and right side plate portions 53 extending downward from both left and right side edges of the upper plate portion 52 and linked to both left and right side edges of the front plate portion 51. An internal space of the wire cover 50 serves as a wire bending space 54 for turning the wires 15 drawn out upward from the wire drawn-out surface 26 rearwardly. The lower surface of the wire bending space 54 is facing the wire drawn-out surface 26 by being open in the lower surface of the wire cover 50. Further, the rear surface of the wire bending space 54 is open as a wire draw-out opening 55 in the rear surface of the wire cover 50.

<Partitioning Portion 56>

The wire cover 50 is formed with a partitioning portion 56 linked to a lower end part of the inner surface of the front plate portion 51 and a lower end part of the inner surface of the right side plate portion 53. With the wire cover 50 mounted on the housing 10, the partitioning portion 56 is in contact with the wire drawn-out surface 26 to cover an opening of the accommodation recess 31 and the accommodation recess 31 is partitioned from the wire bending space 54 by this contact. Further, the lower surface of the partitioning portion 56 functions as a restricting portion 57 configured to be held in contact with or proximately face the upper surface of the ventilation member 62. The partitioning portion 56 is disposed on a side opposite to the wire drawn-out opening 55 in the front-rear direction.

<Drainage Means of Wire Cover 50>

Figure 14:
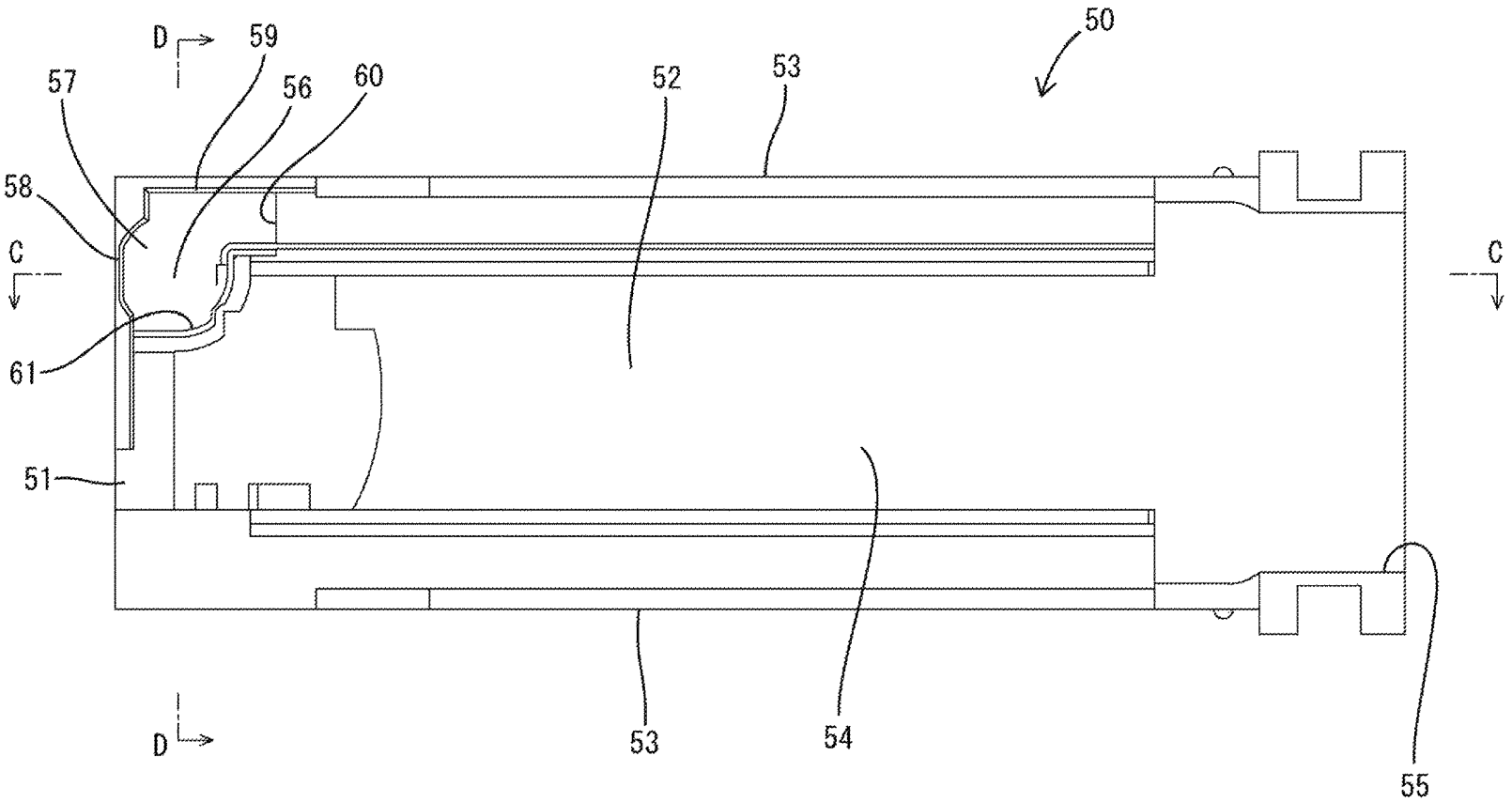
FIG. 14 is a bottom view of the wire cover.
Figure 15:
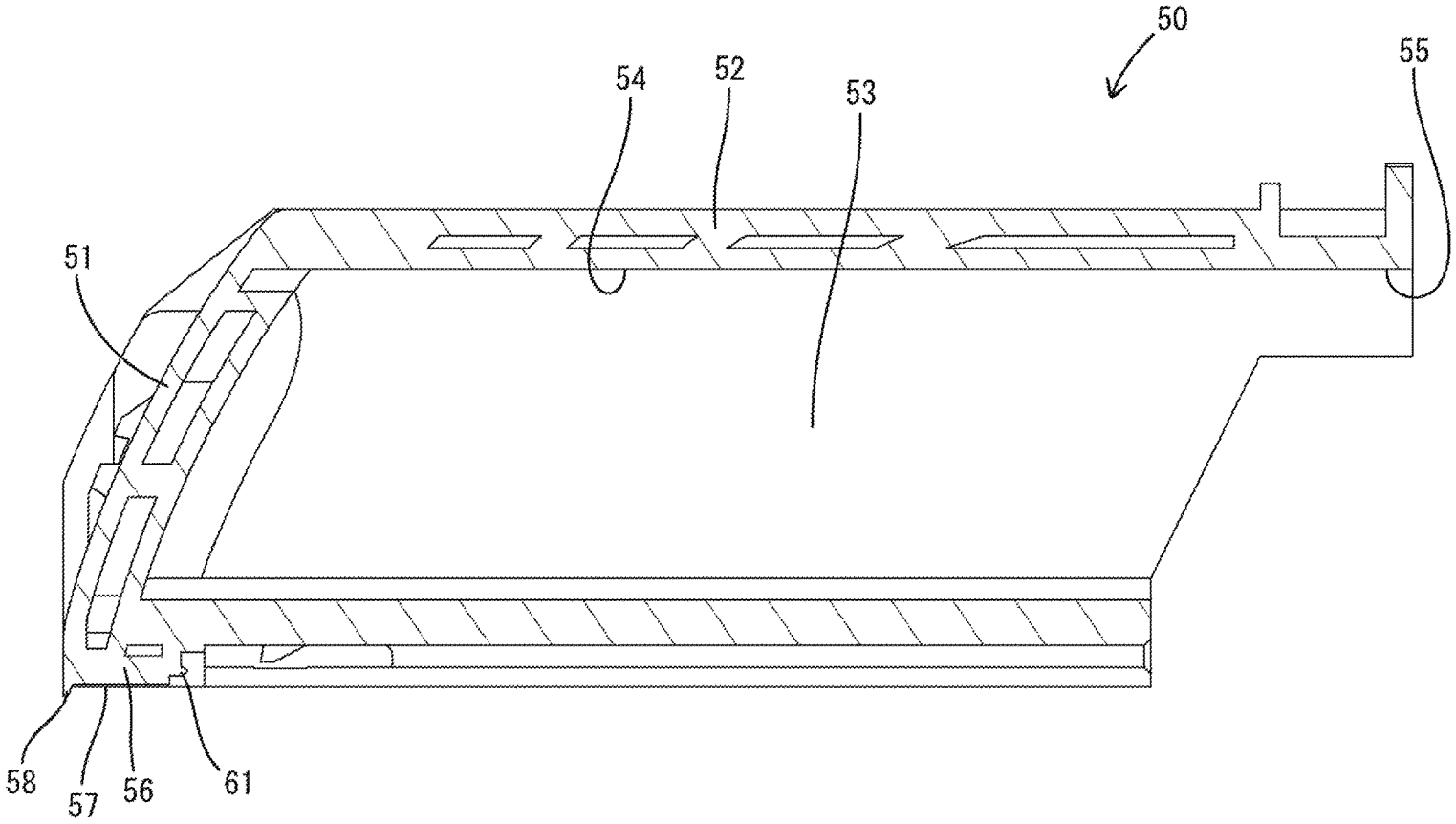
FIG. 15 is a section along C-C of FIG. 14.
Figure 16:
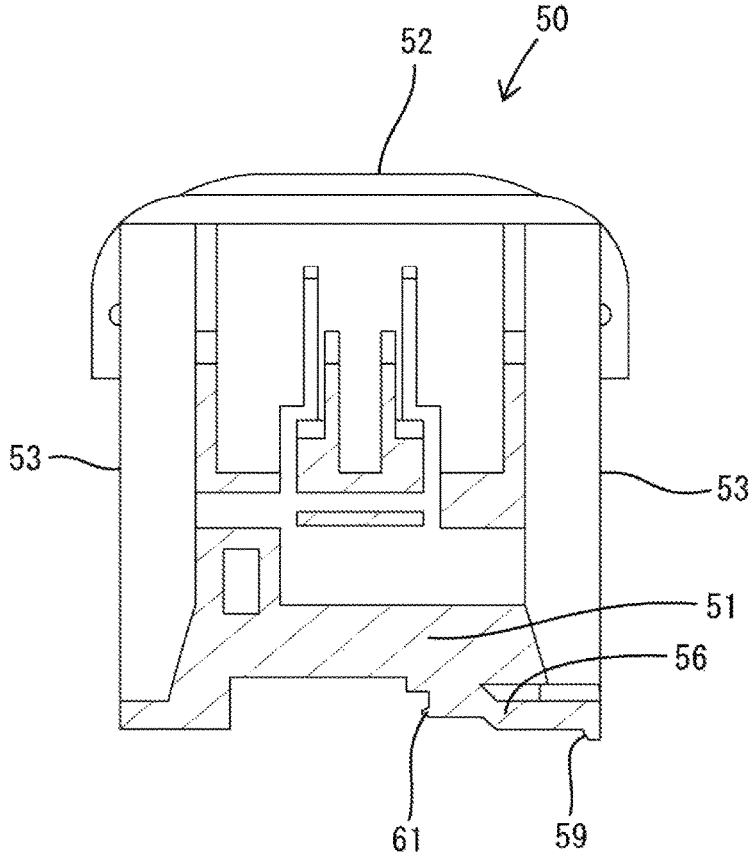
FIG. 16 is a section along D-D of FIG. 14.
Figure 17:
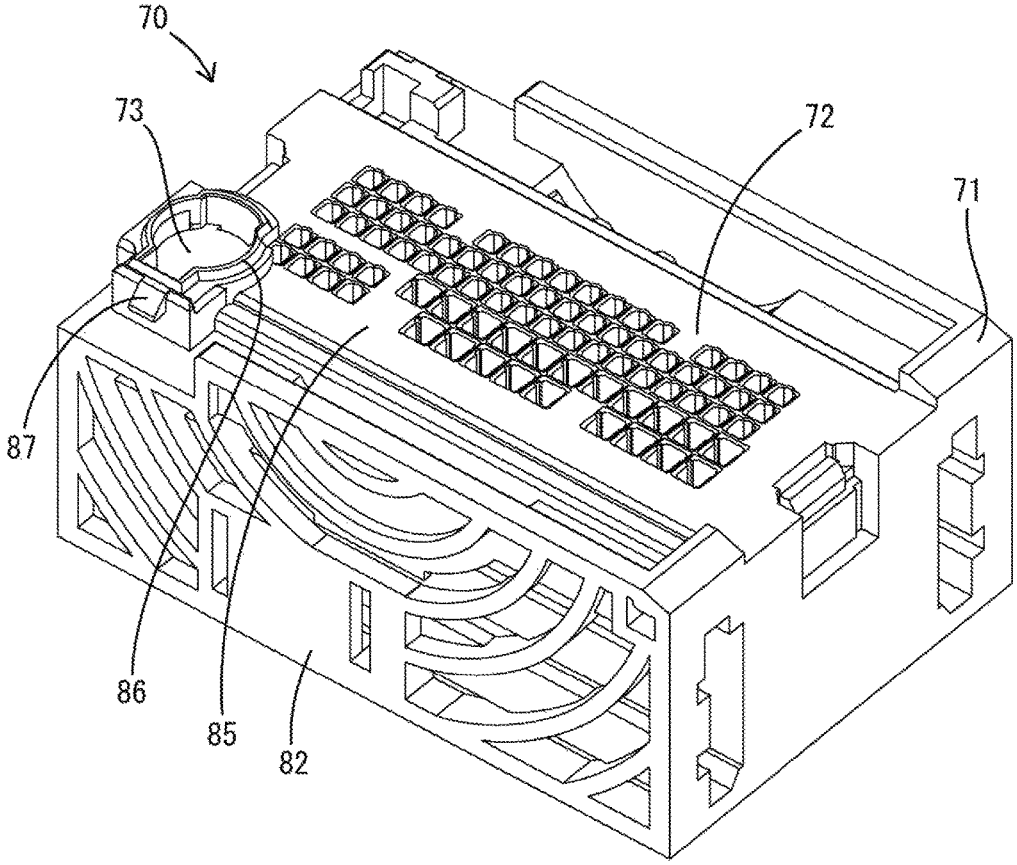
FIG. 17 is a perspective view showing a state where a wire cover and wires are removed in a connector of a second embodiment.

The partitioning portion 56 is formed with a drainage means to be fit to the drainage means of the housing 10 (wire drawn-out surface 26) in a liquid-tight manner over the entire periphery thereof. As shown in FIG. 14, the drainage means of the partitioning portion 56 is composed of a front edge rib 58 (drainage portion as claimed), a right edge rib 59 (drainage portion as claimed), a rear edge step portion 60 (drainage portion as claimed) and an arcuate rib 61 (drainage portion as claimed).

A bottom surface shape of the front edge rib 58 has a bent part and extends in the lateral direction as a whole. The rear surface of the front edge rib 58 is fit to the front edge drainage portion 37 of the wire drawn-out surface 26 over the entire length thereof. The right edge rib 59 extends straight in the front-rear direction as a whole. A left side surface of the right edge rib 59 is fit to the right edge drainage portion 38 of the wire drawn-out surface 26 over the entire length thereof. The right edge drainage portion 38 and the right edge rib 59 are parallel to an assembling direction of the wire cover 50 with the housing 10.

The rear surface of the rear edge step portion 60 extends leftward a short distance from the rear end of the right edge rib 59 in a bottom view. The rear surface of the rear edge step portion 60 is fit to the front surface of the rear edge drainage portion 39. The arcuate rib 61 is formed from a position near the left end of the rear edge step portion 60 to the left end of the front edge rib 58 in a bottom view and projects from the outer peripheral surface of the partitioning portion 56. The arcuate rib 61 is fit to the groove-like arcuate drainage portion 40 of the wire drawn-out surface 26.

<Ventilation Member 62>

The ventilation member 62 includes a disc-shaped ventilation film 63 and a holder 64 (see FIG. 4) to be mounted into the housing 10 while holding the ventilation film 63. The ventilation film 63 is made of a material which allows the passage of air, but does not allow the passage of liquid (moisture). A porous PTFE film is used as a specific example.

The holder 64 is made of synthetic resin and is a single component including an accommodating portion 65 (see FIGS. 11 and 13) for accommodating the ventilation film 63 and a tubular ventilation portion 66 projecting downward from the accommodating portion 65. The inside of the accommodating portion 65 communicates with the outside of the holder 64 via a vent 67 formed in the outer periphery of the accommodating portion 65. The tubular ventilation portion 66 is in the form of a tube whose axis line is oriented in the vertical direction (direction substantially parallel to a film thickness direction of the ventilation film 63) and arranged at a position eccentric from a center of the accommodating portion 65 toward an outer peripheral side. The tubular ventilation portion 66 penetrates through the communication hole 32 and the one-piece rubber plug 19 to face the sealing space, thereby allowing communication between the sealing space and the inside of the accommodating portion 65.

<Functions and Effects of First Embodiment>

The waterproof connector 1 of the first embodiment includes the housing 10, the plurality of terminal fittings 14, the ventilation film 63 and the wire cover 50. The terminal accommodation chambers 13 are formed inside the housing 10, and a part of the outer surface of the housing 10 serves as the wire drawn-out surface 26. The terminal fittings 14 are connected to the end parts of the wires 15 and inserted into the terminal accommodation chambers 13 with the wires 15 drawn to the outside of the housing 10 (up) from the wire drawn-out surface 26.

Further, the wire draw-out surface 26 is formed with the accommodation recess 31 for accommodating the ventilation film 63, and the wire cover 50 is mounted on the housing 10 to cover the wire draw-out surface 26 and the accommodation recess 31. The wire bending space 54 for bending the wires 15 drawn out from the wire draw-out surface 26 is formed inside the wire cover 50. Likewise, the partitioning portion 56 is formed inside the wire cover 50 for partitioning between the accommodation recess 31 and the wire bending space 54 by coming into contact with the wire draw-out surface 26 to cover the opening of the accommodation recess 31.

Since water may enter the inside (wire bending space 54) of the wire cover 50 through the wire draw-out opening 55, the water having entered may be pooled in the accommodation recess 31 for the ventilation film 63 to impair a ventilation function by the ventilation film 63. However, since the opening in the upper surface of the accommodation recess 31 is closed by the partitioning portion 56 and the accommodation recess 31 is partitioned from the wire bending space 54, there is no possibility that water penetrates into the accommodation recess 31.

Further, a clearance in a contact part between an opening edge part of the accommodation recess 31 in the wire draw-out surface 26 and the partitioning portion 56 may become a water penetration route. Specifically, if water having penetrated into the wire bending space 54 from the outside of the wire cover 50 adheres to the outer surface of the accommodation recess 31 or the partitioning portion 56, that water may penetrate into the accommodation recess 31. Accordingly, in a contact area between the wire draw-out surface 26 and the partitioning portion 56, the drainage portions whose cross-sections have a labyrinth shape such as a convexo-concave shape or a stepped shape, i.e. a bent shape are provided.

Specific configurations of the drainage portions are as follows. The front edge drainage portion 37 of the wire draw-out surface 26 and the front edge rib 58 of the partitioning portion 56 come into contact in the front-rear direction, the right edge drainage portion 38 of the wire draw-out surface 26 and the right edge rib 59 of the partitioning portion 56 come into contact in the lateral direction, the rear edge drainage portion 39 of the wire draw-out surface 26 and the rear edge step portion 60 of the partitioning portion 56 come into contact in the front-rear direction and the arcuate drainage portion 40 of the wire draw-out surface 26 and the arcuate rib 61 of the partitioning portion 56 come into contact in the front-rear direction or lateral direction.

Since the drainage portions formed in the contact area between the accommodation recess 31 and the partitioning portion 56 and fit to each other have a convexo-concave or stepped cross-sectional shape, there is no possibility that water in the wire bending space 54 penetrates into the accommodation recess 31. Thus, it is realized to arrange the ventilation film 63 on the wire draw-out surface 26 without impairing the ventilation function of the ventilation film 63.

Further, since the opening of the accommodation recess 31 is facing upward, water may penetrate into the accommodation recess 31 due to dimensional tolerances of the wire draw-out surface 26 and the partitioning portion 56. Accordingly, as a measure against that, the drainage paths 33 open in the lower surface of the accommodation recess 31 are formed in the housing 10. By providing the drainage paths 33, even if water penetrates into the accommodation recess 31, the water having penetrated is discharged to the outside of the housing 10 through the drainage paths 33. Therefore, there is no possibility that water is pooled in the accommodation recess 31.

Further, the blocking portion 36 forming the drainage path 33 into a bent route is provided at the intermediate position of the drainage route in the drainage path 33. According to this configuration, even if water penetrates into the drainage path 33 from a downstream end of the drainage path 33 (lower part of the accommodation recess 31) and moves toward the accommodation recess 31, a movement of that water is blocked in the bent part, wherefore there is no possibility that the water reaches the accommodation recess 31.

Further, the waterproof connector 1 includes the one-piece rubber plug 19 mounted in the housing 10 while allowing the wires 15 to pass therethrough in an airtight manner. The peripheral wall portion 16 is formed in the upper end part of the housing 10 and the one-piece rubber plug 19 is surrounded in an airtight manner by the peripheral wall portion 16. The ventilation film 63 is accommodated in the accommodating portion 65 of the holder 64 and the holder 64 is formed with the tubular ventilation portion 66 vertically penetrating through the one-piece rubber plug 19 and allowing communication between the inside of the accommodating portion 65 and the sealing space. The accommodation recess 31 is formed from the inner side to the outer side of the peripheral wall portion 16 and upstream ends (drainage holes 34) of the drainage paths 33 are open in an area of the accommodation recess 31 outside the peripheral wall portion 16. According to this configuration, the shape of the tubular ventilation portion 66 and those of the drainage paths 33 can be simplified without being bent.

Further, the wire cover 50 is formed with the restricting portion 57 for restricting a displacement of the ventilation member 62 (ventilation film 63) in a direction separating from the accommodation recess 31. The restricting portion 57 is located to be held in contact with or proximately face the upper surface of the accommodating portion 65 of the holder 64 of the ventilation member 62. According to this configuration, since the ventilation film 63 can be prevented from being separated from the accommodation recess 31 even if the accommodation recess 31 is not formed with a resiliently deformable locking means, the shape of the accommodation recess 31 can be simplified.

Second Embodiment

Next, a second specific embodiment of the present invention is described with reference to FIGS. 17 to 27. A waterproof connector 2 of the second embodiment includes a housing 70, a plurality of female terminal fittings 14 (not shown), a one-piece rubber plug 19, a seal ring 21, a pair of sliders 42, a lever 46, a wire cover 88 and a ventilation member 62. Since a basic configuration of the housing 70, those of the terminal fittings 14 and the one-piece rubber plug 19, that of the seal ring, that of the sliders, that of the lever and the ventilation member 62 are substantially the same as or the same as those in the first embodiment, these are not described.

Figure 18:
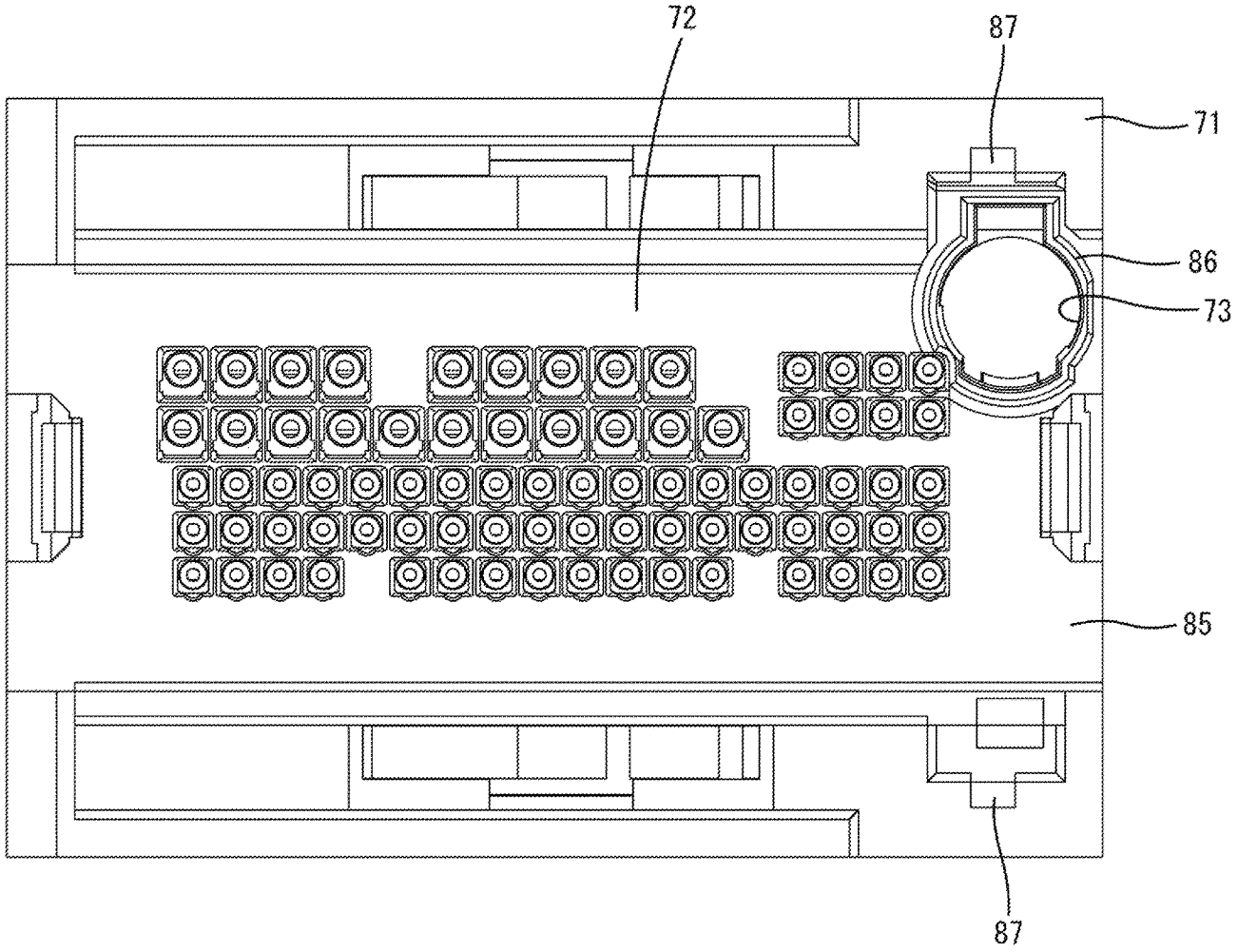
FIG. 18 is a plan view showing a ventilation member mounted in a housing.
Figure 19:
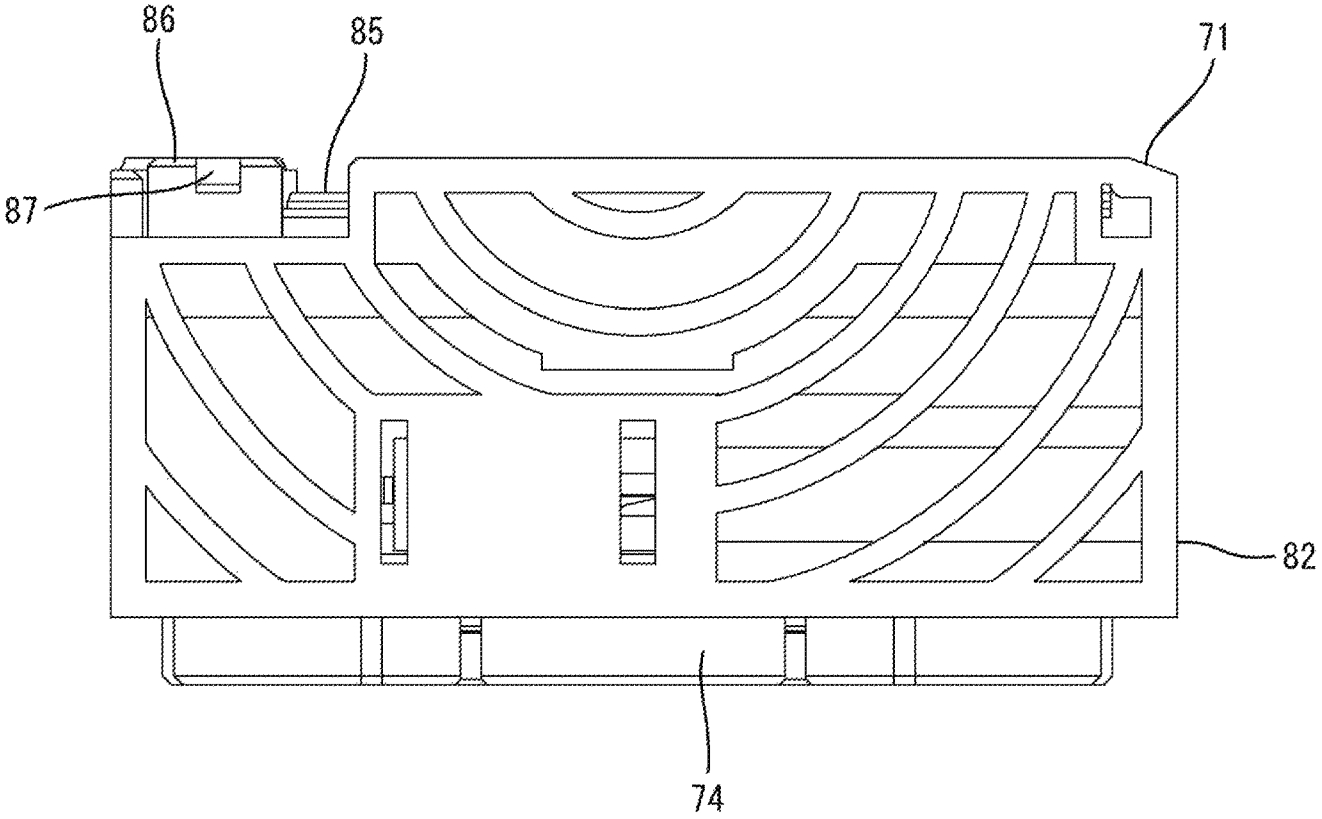
FIG. 19 is a right side view showing the ventilation member is mounted in the housing.
Figure 20:
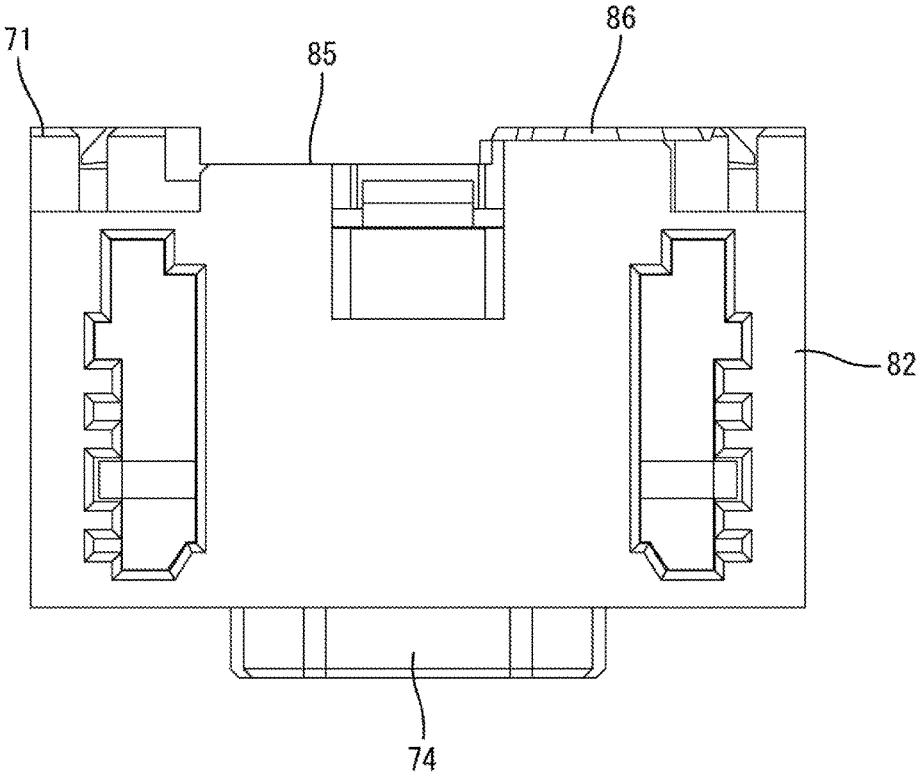
FIG. 20 is a front view showing the ventilation member mounted in the housing.
Figure 21:
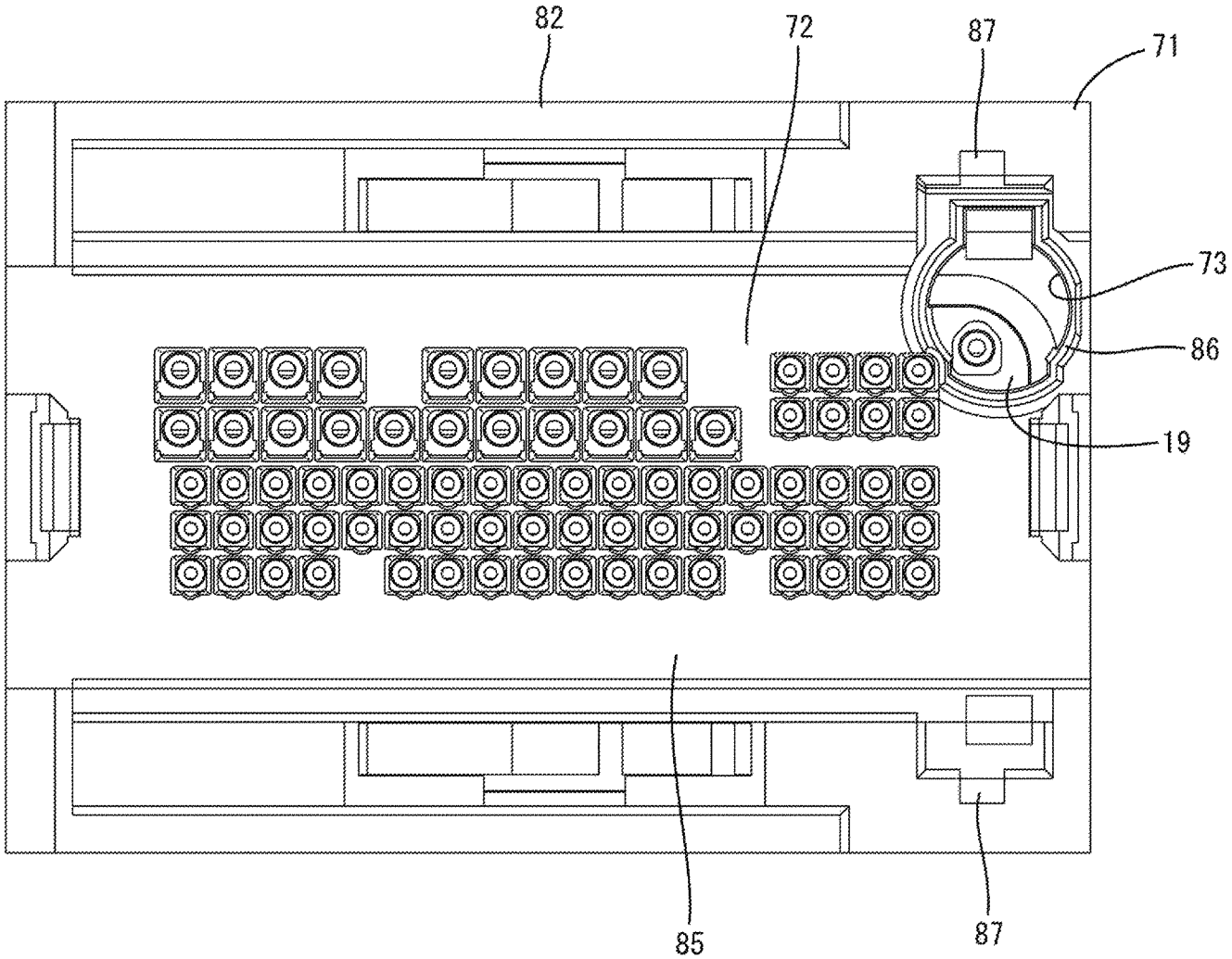
FIG. 21 is a plan view showing the ventilation member removed from FIG. 18.
Figure 26:
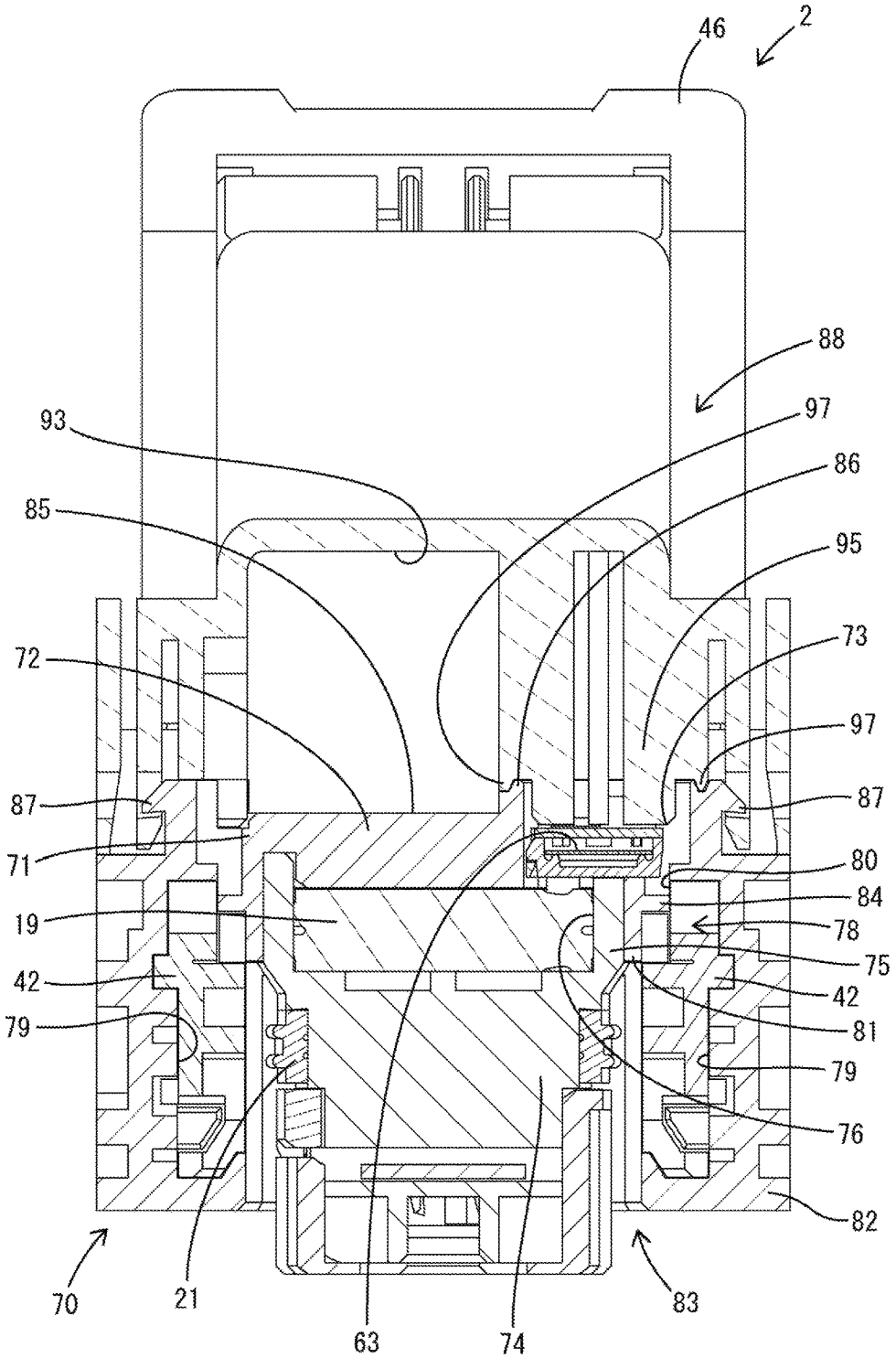
FIG. 26 is a section along F-F of FIG. 23.
Figure 27:
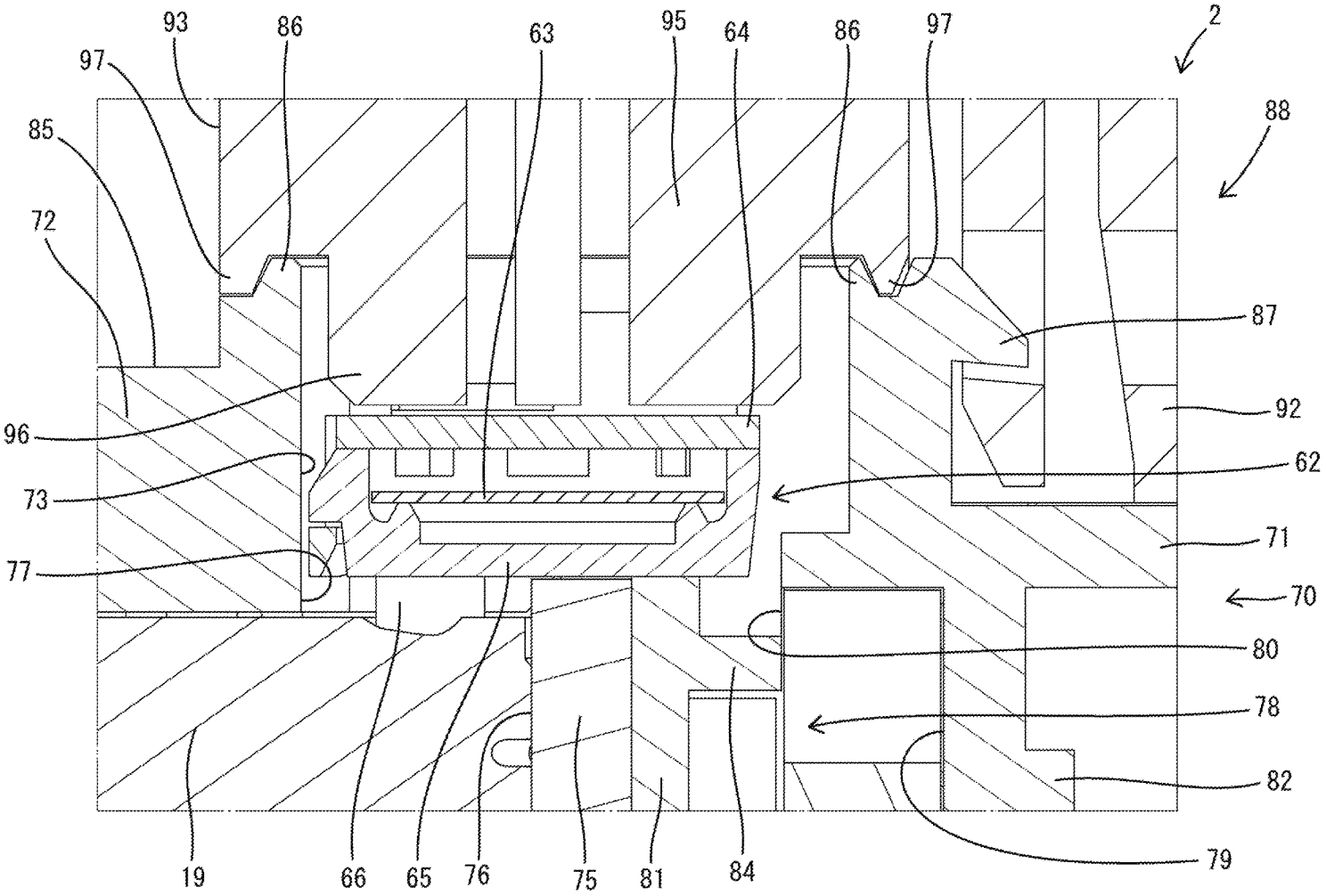
FIG. 27 is a partial enlarged view of FIG. 26.

Note that, in the following description, a right side in FIGS. 18, 21, 22, 24 and 25 is defined as a front concerning a front-rear direction. Upper and lower sides shown in FIGS. 17, 19, 20 and 24 to 27 are directly defined as upper and lower sides concerning a vertical direction. An upper side in FIGS. 18, 21 is defined as a right side and left and right sides shown in FIGS. 20, 26 and 27 are directly defined as left and right sides concerning a lateral direction.

<Accommodation Recess 73>

An outer housing 71 constituting the housing 70 is formed with an accommodation recess 73 for accommodating the ventilation member 62 to be described later. The accommodation recess 73 is formed by recessing a right-front end part of the upper surface (outer surface) of a back wall portion 72. As shown in FIG. 21, in a plan view, the accommodation recess 73 is formed from the inside (rubber plug accommodation space 76) to the outside of a peripheral wall portion 75 of an inner housing 74 constituting the housing 70.

Specifically, a front end part of the accommodation recess 73 is disposed outside the rubber plug accommodation space 76 (before the front end of the peripheral wall portion 75) and a rear end part of the accommodation recess 73 is inside the rubber plug accommodation space 76. Further, a right part of the accommodation recess 73 is outside the rubber plug accommodation space 76 (to the right of the right end of the peripheral wall portion 75) and a left part of the accommodation recess 73 is inside the rubber plug accommodation space 76. The upper surface of the accommodation recess 73 is entirely open in a wire draw-out surface 85. A communication hole 77 is formed in the lower surface of the accommodation recess 73 and communicates with the rubber plug accommodation space 76 (see FIG. 25).

<Drainage Passages 78>

Drainage holes 80 communicating with the upper ends of guide recesses 79 in side wall portions of the outer housing 71 are formed in the lower surface of the accommodation recess 73 as shown in FIG. 26. The drainage holes 80 are formed at positions near supporting plate portions 81 in the lateral direction. The drainage holes 80, clearances between the inner surfaces of the guide recesses 79 and the sliders and a connection space 83 between a tubular fitting portion 82 of the outer housing 71 and the outer periphery of the inner housing 74 constitute drainage paths 78. The drainage paths 78 function as drainage routes for discharging liquid to the outside of the housing 70 when the liquid such as water penetrates into the accommodation recesses 73.

A blocking portion 84 is formed at an intermediate position of the drainage path 78. The blocking portion 84 laterally projects from a surface of the supporting plate portion 81 facing the rubber plug accommodation space 76. The upper surface of the blocking portion 84 is facing an opening in the lower end of the drainage hole 80 while being spaced therefrom. The projecting end surface of the blocking portion 84 slides in contact with the inner surface of the slider 42 or faces the inner surface of the slider 42 with a tiny clearance defined therebetween. An area of the drainage path 78 where the blocking portion 84 is formed serves as a route bent along both upper and lower surfaces and the projecting end surface of the blocking portion 84.

<Drainage Means of Wire Draw-Out Surface 26>

The wire draw-out surface 85 is formed with a drainage means surrounding the accommodation recess 73 substantially over the entire periphery in a plan view as shown in FIGS. 18 and 21. The drainage means is composed of an upward facing rib 86 (drainage portion as claimed) standing up from the wire draw-out surface 85. The outer peripheral surface of the upward facing rib 86 is oblique to the wire draw-out surface 85 and also oblique to the vertical direction perpendicular to a wire projecting surface. Further, left and right lock projections 87 for locking the wire cover 88 in a mounted state on the housing 70 are formed on a front end part of the upper surface (wire draw-out surface 85) of the outer housing 71. The right lock projection 87 is disposed adjacent to a right end part of the upward facing rib 86.

<Wire Cover 88>

Figure 24:
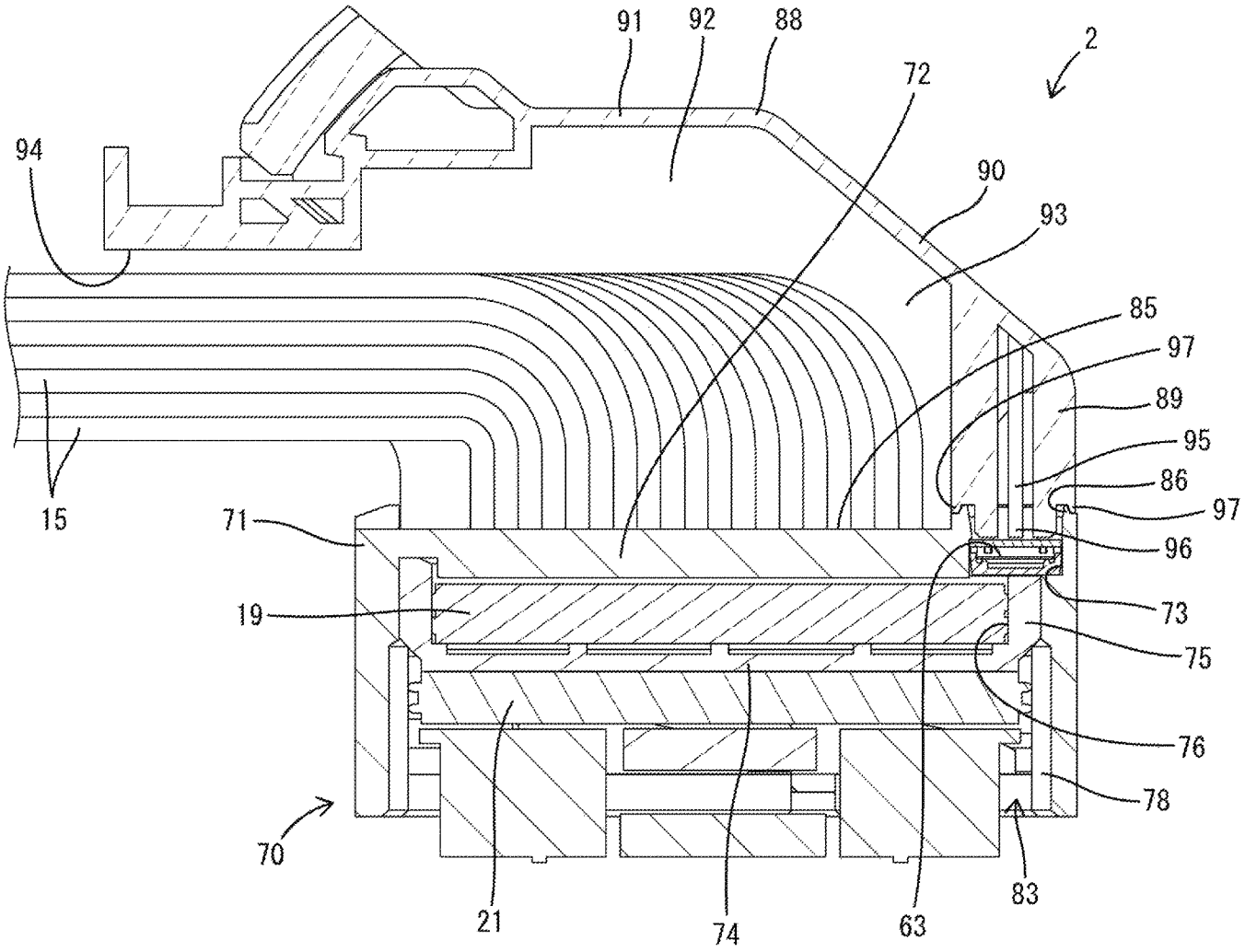
FIG. 24 is a section along E-E of FIG. 23.
Figure 25:
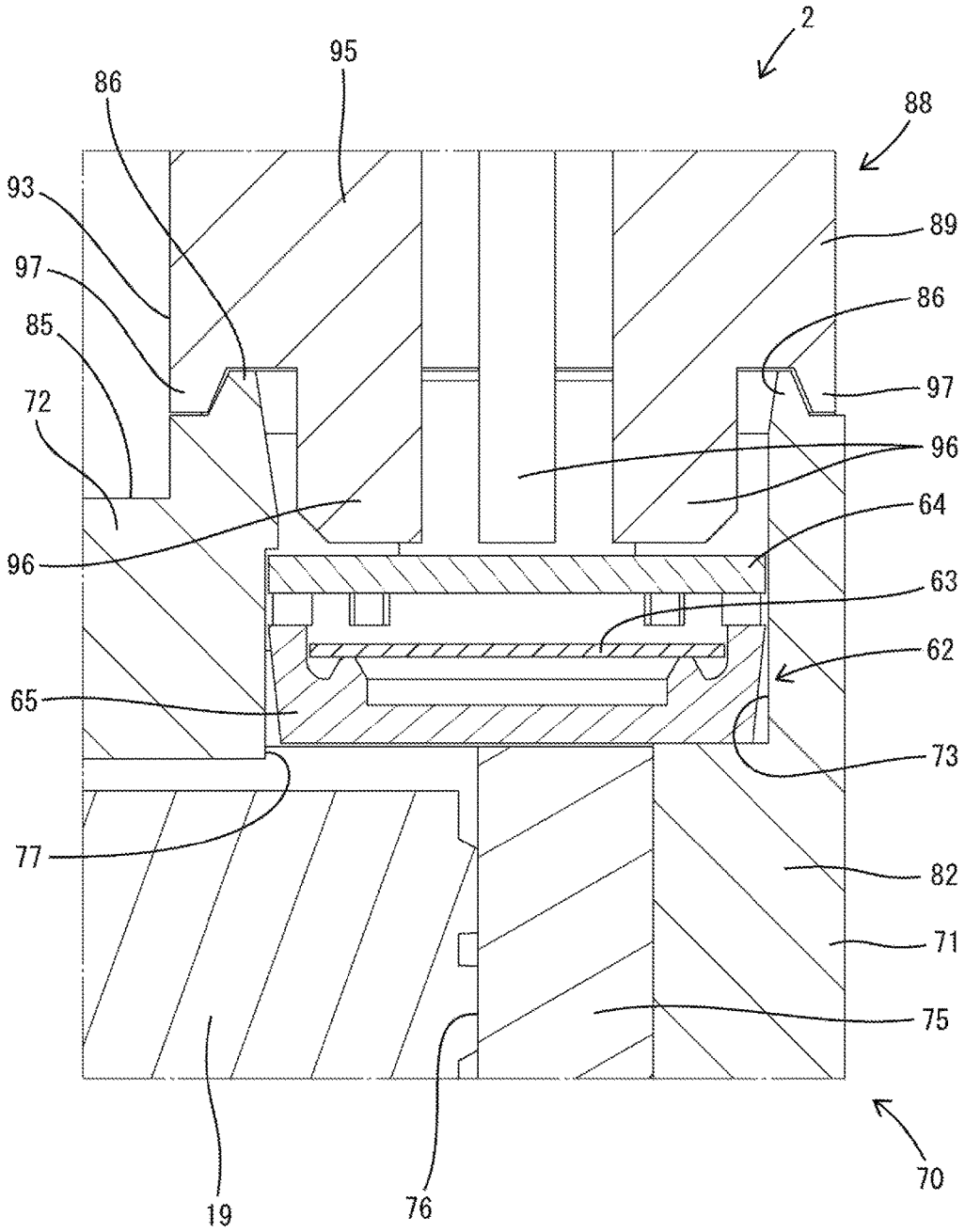
FIG. 25 is a partial enlarged view of FIG. 24.

As shown in FIG. 24, the wire cover 88 is for turning a plurality of wires 15 drawn out upward from the wire drawn-out surface 85 of the housing 70 (outer housing 71) rearwardly. The wire cover 88 is mounted on the outer housing 71 from above and covers the entire area of the wire drawn-out surface 85.

The wire cover 88 includes a front plate portion 89, an oblique plate portion 90 extending obliquely to an upper-rear side from the upper end edge of the front plate portion 89, an upper plate portion 91 extending rearward from the upper end edge of the oblique plate portion 90 and a pair of left and right side plate portions 92 extending downward from both left and right side edges of the oblique plate portion 90 and the upper plate portion 91 and linked to both left and right side edges of the front plate portion 89. An internal space of the wire cover 88 serves as a wire bending space 93 for turning the wires 15 drawn out upward from the wire drawn-out surface 85 rearwardly. The wire bending space 93 is facing the wire drawn-out surface 85 by being open in the lower surface of the wire cover 88. Further, the wire bending space 93 is open as a wire draw-out opening 94 in the rear surface of the wire cover 88.

<Partitioning Portion 95>

The wire cover 88 is formed with a partitioning portion 95 linked to the inner surface of the front plate portion 89, the inner surface of a front end part of the oblique plate portion 90 and the inner surface of the right side plate portion 92. With the wire cover 88 mounted on the housing 70, the partitioning portion 95 is in contact with the wire drawn-out surface 85 to cover an opening of the accommodation recess 73 and the accommodation recess 73 is partitioned from the wire bending space 93 by this contact. Further, a restricting portion 96 configured to be held in contact with or proximately face the upper surface of the ventilation member 62 is formed on a lower end part of the partitioning portion 95. The partitioning portion 95 is disposed on a side opposite to the wire drawn-out opening 94 in the front-rear direction.

<Drainage Means of Wire Cover 88>

Figure 22:
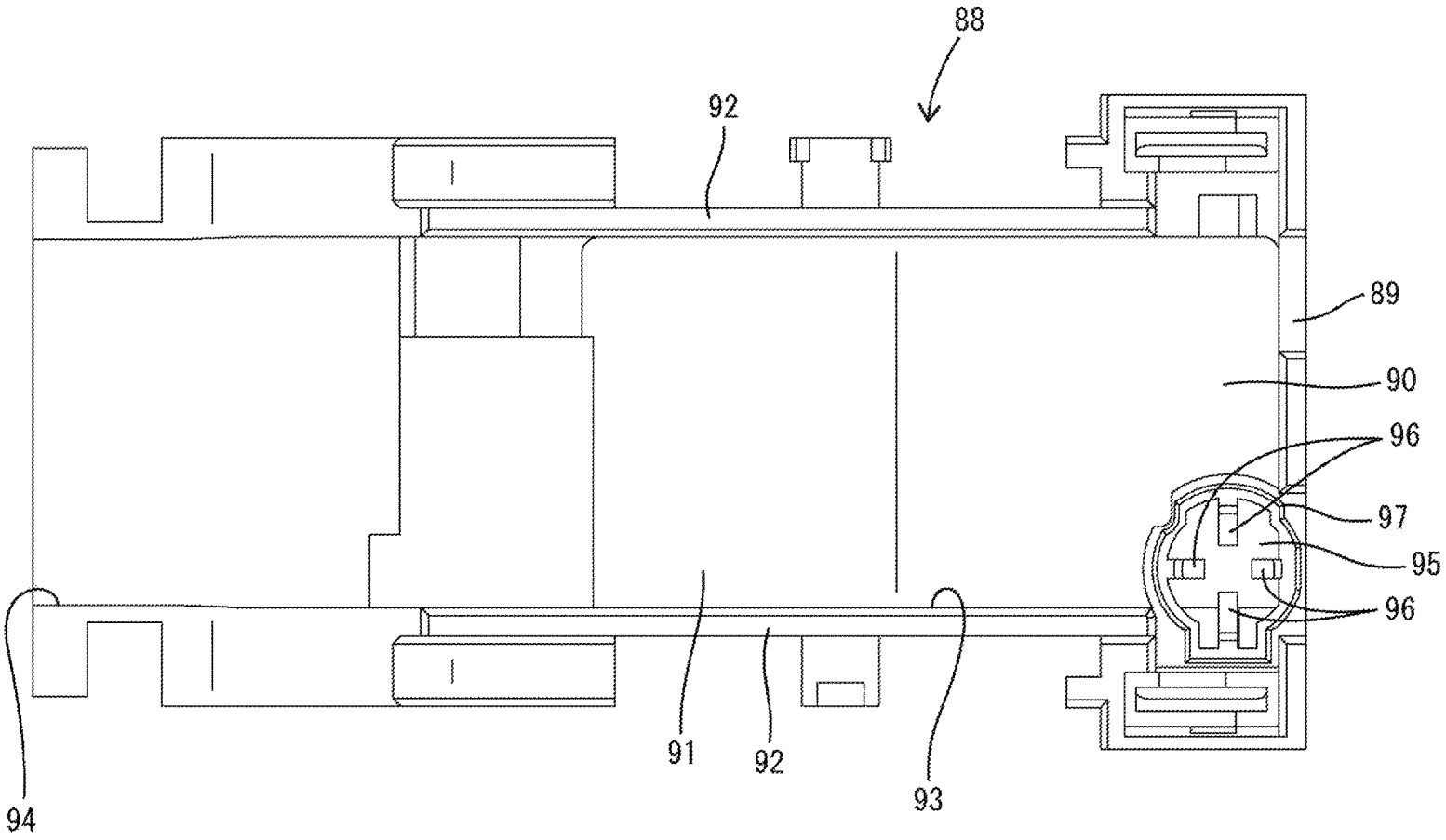
FIG. 22 is a bottom view of the wire cover.
Figure 23:
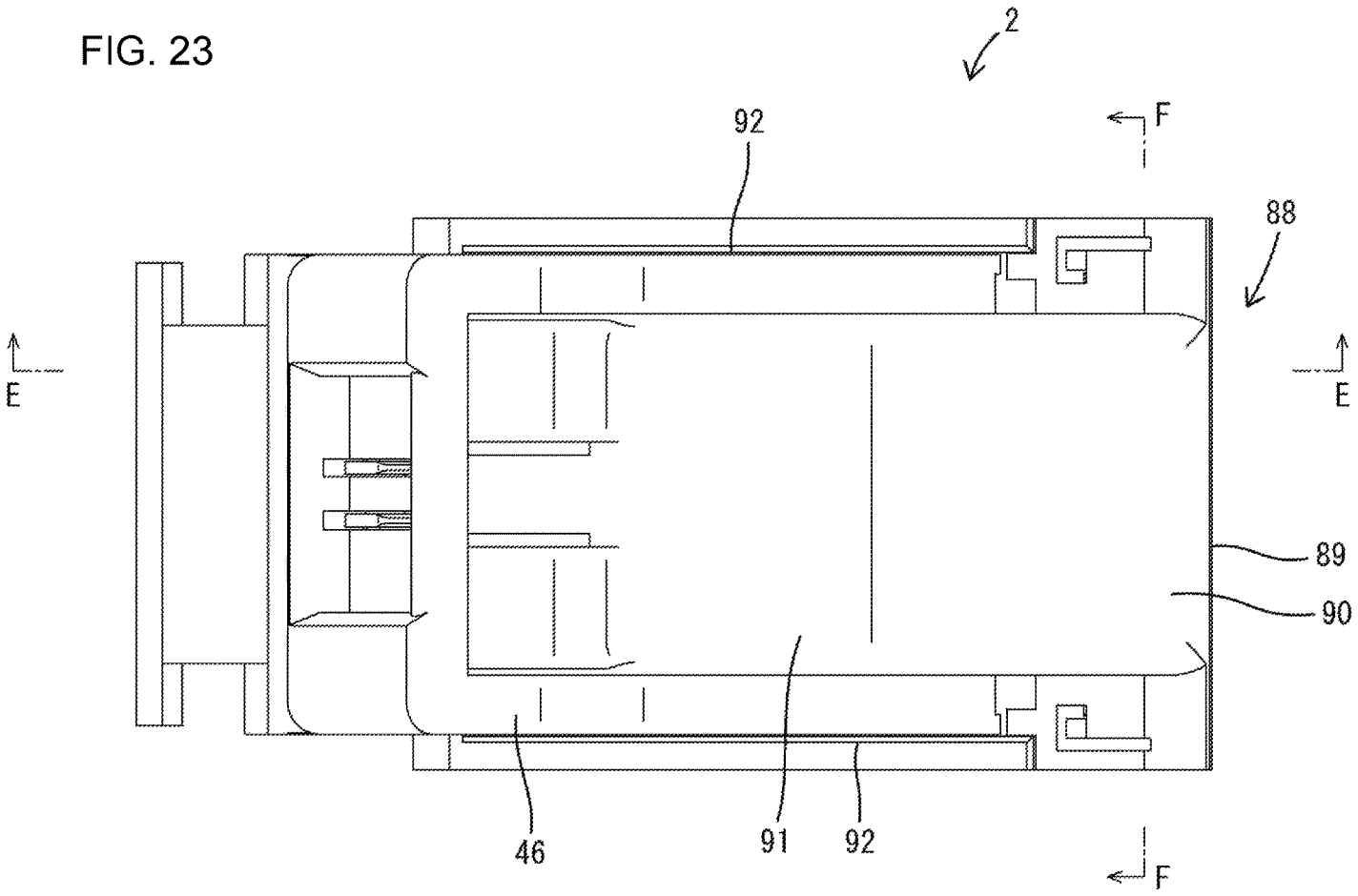
FIG. 23 is a plan view of the connector.

A downward facing rib 97 (drainage portion as claimed) is formed as a drainage means to be fit to the drainage means of the housing 70 (wire draw-out surface 85) over the entire periphery in a liquid-tight manner. As shown in FIG. 22, the downward facing rib 97 is disposed to extend along the outer periphery of the partitioning portion 95 and surround the restricting portion 96 in a bottom view. Further, the downward facing rib 97 is disposed at a position above the restricting portion 96. The inner peripheral surface of the downward facing rib 97 is oblique to a horizontal plane and also oblique to the vertical direction.

<Functions and Effects of Second Embodiment>

The waterproof connector 2 of the second embodiment includes the housing 70, the terminal fittings 14, the ventilation film 63 and the wire cover 88. Terminal accommodation chambers (not shown) are formed inside the housing 70, and a part of the outer surface of the housing 70 serves as the wire drawn-out surface 85. The terminal fittings 14 are connected to end parts of the wires 15 and inserted into the terminal accommodation chambers with the wires 15 drawn to the outside of the housing 70 (upwardly) from the wire drawn-out surface 85.

Further, the wire draw-out surface 85 is formed with the accommodation recess 73 for accommodating the ventilation member 62 (ventilation film 63), and the wire cover 88 is mounted on the housing 70 to cover the wire draw-out surface 85 and the accommodation recess 73. The wire bending space 93 for bending the wires 15 drawn out from the wire draw-out surface 85 is formed inside the wire cover 88. Likewise, the partitioning portion 95 for partitioning between the accommodation recess 73 and the wire bending space 93 by coming into contact with the wire draw-out surface 85 to cover the opening of the accommodation recess 73 is formed inside the wire cover 88.

Since water may enter the inside (wire bending space 93) of the wire cover 88 through the wire draw-out opening 94, the water having entered may be pooled in the accommodation recess 73 for the ventilation film 63 to impair a ventilation function by the ventilation film 63. However, since the opening in the upper surface of the accommodation recess 73 is closed by the partitioning portion 95 and the accommodation recess 73 is partitioned from the wire bending space 93, there is no possibility that water penetrates into the accommodation recess 73.

Further, a clearance in a contact part between an opening edge part of the accommodation recess 73 in the wire draw-out surface 85 and the partitioning portion 95 may become a water penetration route. Specifically, if water having penetrated into the wire bending space 93 from the outside of the wire cover 88 adheres to the outer surface of the accommodation recess 73 or the partitioning portion 95, that water may penetrate into the accommodation recess 73. Accordingly, in a contact area between the wire draw-out surface 85 and the partitioning portion 95, the drainage portions whose cross-sections have a labyrinth shape such as a convexo-concave shape or a stepped shape, i.e. a bent shape are provided.

Specific configurations of the drainage portions are as follows. The outer peripheral surface of the upward facing rib 86 of the wire draw-out surface 85 and the inner peripheral surface of the downward facing rib 97 of the wire cover 88 (partitioning portion 95) are in contact over the entire periphery. Since the upward facing rib 86 and the downward facing rib 97 have a stepped cross-sectional shape, there is no possibility that water in the wire bending space 93 penetrates into the accommodation recess 73. Thus, the ventilation film 63 can be arranged on the wire draw-out surface 85 without impairing the ventilation function of the ventilation film 63.

Further, the opening of the accommodation recess 73 faces up, and water may penetrate into the accommodation recess 73 due to dimensional tolerances of the wire draw-out surface 85 and the partitioning portion 95. Accordingly, as a measure against that, the drainage paths 78 open in the lower surface of the accommodation recess 73 are formed in the housing 70. By providing the drainage paths 78, even if water penetrates into the accommodation recess 73, the water having penetrated is discharged to the outside of the housing 70 through the drainage paths 78. Therefore, there is no possibility that water is pooled in the accommodation recess 73.

Further, the blocking portion 84 forming the drainage path 78 into a bent route is provided at the intermediate position of the drainage route in the drainage path 78. According to this configuration, even if water penetrates into the drainage path 78 from a downstream end of the drainage path 78 (lower part of the accommodation recess 73) and moves toward the accommodation recess 73, a movement of that water is blocked in the bent part, wherefore there is no possibility that the water reaches the accommodation recess 73.

Further, the waterproof connector 2 includes the one-piece rubber plug 19 mounted in the housing 70 while allowing the wires 15 to pass therethrough in an airtight manner. The peripheral wall portion 75 is formed in the upper end part of the housing 70 and the one-piece rubber plug 19 is surrounded in an airtight manner by the peripheral wall portion 75. The ventilation film 63 is accommodated in an accommodating portion 65 of a holder 64 and the holder 64 is formed with a tubular ventilation portion 66 vertically penetrating through the one-piece rubber plug 19 and allowing communication between the inside of the accommodating portion and a sealing space (not shown). The accommodation recess 73 is formed from the inner side to the outer side of the peripheral wall portion 75 and upstream ends (drainage holes 80) of the drainage paths 78 are open in an area of the accommodation recess 73 outside the peripheral wall portion 75. According to this configuration, the shape of the tubular ventilation portion and those of the drainage paths 78 can be simplified without being bent.

Further, the wire cover 88 is formed with the restricting portion 96 for restricting a displacement of the ventilation member 62 (ventilation film 63) in a direction separating from the accommodation recess 73. The restricting portion 96 is located to be held in contact with or proximately face the upper surface of the accommodating portion of the holder 64 of the ventilation member 62. According to this configuration, since the ventilation film 63 can be prevented from being separated from the accommodation recess 73 even if the accommodation recess 73 is not formed with a resiliently deformable locking means, the shape of the accommodation recess 73 can be simplified. Further, since an assembling direction of the wire cover 88 with the housing 70 is a downward direction, the lift of the ventilation member 62 can be reliably prevented by inserting the restricting portion 96 projecting downward into the accommodation recess 73.

Other Embodiments

The invention is not limited to the above described and illustrated embodiments. For example, the following embodiments also are included in the technical scope of the invention.

Although the drainage paths are formed in the housing in the above first and second embodiments, the housing may include no drainage path.

Although the one-piece rubber plug is used as a waterproofing means on the wire draw-out surface in the above first and second embodiments, there is no limitation to this and an opening of each terminal accommodation chamber may be sealed by an individual rubber plug individually mounted on each wire.

Although the blocking portion having a bent shape is formed at the intermediate position of the drainage route in the drainage path in the above first and second embodiments, the drainage path may have no bent part.

Although the accommodation recess is formed from the inner side to the outer side of the peripheral wall portion in the above first and second embodiments, the accommodation recess may be formed only on the inner side of the peripheral wall portion or may be formed only on the outer side of the peripheral wall portion. In the former case, the drainage path can be disposed outside the peripheral wall portion by having a bent shape. In the latter case, the tubular ventilation portion can be disposed inside the peripheral wall portion by forming the tubular ventilation portion into a bent shape.

Although the wire cover is formed with the restricting portion as a means for restricting the separation of the ventilation film from the accommodation recess in the above first and second embodiments, there is no limitation to this and the separation of the ventilation film may be restricted by a resiliently deformable locking means formed in the accommodation recess.

LIST OF REFERENCE SIGNS

1, 2 . . . waterproof connector
10, 70 . . . housing
13 . . . terminal accommodation chamber
14 . . . terminal fitting
15 . . . wire
16, 75 . . . peripheral wall
19 . . . one-piece rubber plug
26, 85 . . . wire draw-out surface
31, 73 . . . accommodation recess
33, 78 . . . drainage path
36, 84 . . . blocking portion
37 . . . front edge drainage portion (drainage portion)
38 . . . right edge drainage portion (drainage portion)
39 . . . rear edge drainage portion (drainage portion)
40 . . . arcuate drainage portion (drainage portion)
50, 88 . . . wire cover
54, 93 . . . wire bending space
56, 95 . . . partitioning portion
57, 96 . . . restricting portion
58 . . . front edge rib (drainage portion)
59 . . . right edge rib (drainage portion)
60 . . . rear edge step portion (drainage portion)
61 . . . arcuate rib (drainage portion)
63 . . . ventilation film
64 . . . holder
66 . . . tubular ventilation portion
86 . . . upward facing rib (drainage portion)
97 . . . downward facing rib (drainage portion)

What is claimed is:

1. A waterproof connector, comprising:

a housing formed with a terminal accommodation chamber inside, a wire draw-out surface being defined on a part of an outer surface of the housing;

a terminal fitting connected to an end part of a wire, the terminal fitting being inserted into the terminal accommodation chamber with the wire drawn to outside of the housing from the wire draw-out surface;

an upwardly open accommodation recess formed in the wire draw-out surface and configured to accommodate a ventilation film;

a drainage path formed in the housing and being open in a lower surface of the accommodation recess, a blocking portion formed at an intermediate position of a drainage route in the drainage path and forming the drainage path into a bent route;

a wire cover configured to cover the wire draw-out surface and the accommodation recess;

a wire bending space formed inside the wire cover and configured to bend the wire drawn out from the wire draw-out surface;

a partitioning portion formed in the wire cover and configured to partition between the accommodation recess and the wire bending space by being brought into contact with the wire draw-out surface to cover an opening of the accommodation recess; and a drainage portion formed in a contact area between the wire draw-out surface and the partitioning portion and having a convexo-concave or stepped cross-sectional shape.

2. A waterproof connector, comprising:

a housing formed with a terminal accommodation chamber inside, a wire draw-out surface being defined on a part of an outer surface of the housing;

a terminal fitting connected to an end part of a wire, the terminal fitting being inserted into the terminal accommodation chamber with the wire drawn to outside of the housing from the wire draw-out surface;

an accommodation recess formed in the wire draw-out surface and configured to accommodate a ventilation film;

a wire cover configured to cover the wire draw-out surface and the accommodation recess;

a wire bending space formed inside the wire cover and configured to bend the wire drawn out from the wire draw-out surface;

a partitioning portion formed in the wire cover and configured to partition between the accommodation recess and the wire bending space by being brought into contact with the wire draw-out surface to cover an opening of the accommodation recess; and a drainage portion formed in a contact area between the wire draw-out surface and the partitioning portion and having a convexo-concave or stepped cross-sectional shape;

a one-piece rubber plug mounted in the housing with the wire passed therethrough in an airtight manner;

a peripheral wall formed in the housing and configured to surround the one-piece rubber plug in an airtight manner; and a holder including a tubular ventilation portion penetrating through the one-piece rubber plug and configured to accommodate the ventilation film;

wherein:

the accommodation recess is formed from an inner side to an outer side of the peripheral wall; and an upstream end of the drainage path is open in an area of the accommodation recess outside the peripheral wall.

3. A waterproof connector comprising:

a housing formed with a terminal accommodation chamber inside, a wire draw-out surface being defined on a part of an outer surface of the housing;

a terminal fitting connected to an end part of a wire, the terminal fitting being inserted into the terminal accommodation chamber with the wire drawn to outside of the housing from the wire draw-out surface;

an accommodation recess formed in the wire draw-out surface and configured to accommodate a ventilation film;

a wire cover configured to cover the wire draw-out surface and the accommodation recess, a wire bending space formed inside the wire cover and configured to bend the wire drawn out from the wire draw-out surface, a restricting portion formed in the wire cover and configured to restrict a displacement of the ventilation film in a direction separating from the accommodation recess, a partitioning portion formed in the wire cover and configured to partition between the accommodation recess and the wire bending space by being brought into contact with the wire draw-out surface to cover an opening of the accommodation recess; and a drainage portion formed in a contact area between the wire draw-out surface and the partitioning portion and having a convexo-concave or stepped cross-sectional shape.

4. The waterproof connector of claim 3, wherein the opening of the accommodation recess is facing upward, and a drainage path open in a lower surface of the accommodation recess is formed in the housing.

5. The waterproof connector of claim 4, comprising a blocking portion formed at an intermediate position of a drainage route in the drainage path and forming the drainage path into a bent route.

* * * * *